US007574748B2

(12) United States Patent
Fisher et al.

(10) Patent No.: US 7,574,748 B2
(45) Date of Patent: Aug. 18, 2009

(54) GLOVE WITH SUPPORT SYSTEM

(75) Inventors: Sam Fisher, Beaverton, OR (US); Juan-Pier Antonio Spampinato, Aloha, OR (US); Richard Avis, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 346 days.

(21) Appl. No.: 11/368,995

(22) Filed: Mar. 7, 2006

(65) Prior Publication Data

US 2009/0172864 A1 Jul. 9, 2009

(51) Int. Cl.
*A41D 13/08* (2006.01)

(52) U.S. Cl. ..... 2/16; 2/160

(58) Field of Classification Search ..... 2/16, 2/20, 160, 163

See application file for complete search history.

(56) References Cited

U.S. PATENT DOCUMENTS

| | | | | |
|---|---|---|---|---|
| 321,529 | A | 7/1885 | Rate | |
| 1,268,103 | A | 6/1918 | Fleming | |
| 1,316,292 | A | 9/1919 | Fleming | |
| 1,337,957 | A | 4/1920 | Rasmussen | |
| 1,388,618 | A * | 8/1921 | Stein et al. | 2/21 |
| 1,509,801 | A | 9/1924 | Walters | |
| 1,951,190 | A * | 3/1934 | Gambee | 2/21 |
| 4,272,849 | A * | 6/1981 | Thurston et al. | 2/16 |
| 4,507,804 | A * | 4/1985 | Consigny | 2/21 |
| 4,675,914 | A | 6/1987 | Mitchell | |
| 4,766,612 | A * | 8/1988 | Patton, Sr. | 2/16 |
| 5,453,064 | A | 9/1995 | Williams, Jr. | |
| 5,628,069 | A | 5/1997 | Ebert | |
| 5,794,261 | A | 8/1998 | Hefling | |
| 6,058,503 | A * | 5/2000 | Williams | 2/16 |
| 6,182,293 | B1 | 2/2001 | Mustin | |
| 6,557,177 | B2 * | 5/2003 | Hochmuth | 2/159 |
| 6,584,615 | B1 * | 7/2003 | Wilder et al. | 2/16 |
| 6,654,964 | B1 | 12/2003 | Staihar et al. | |
| 6,684,406 | B2 * | 2/2004 | Fowler | 2/16 |
| 6,990,689 | B1 | 1/2006 | Thellmann | |
| 2004/0187190 | A1 | 9/2004 | Wilder et al. | |
| 2005/0153153 | A1 | 7/2005 | Saur et al. | |

FOREIGN PATENT DOCUMENTS

| | | |
|---|---|---|
| DE | 10010404 | 9/2001 |
| GB | 2311929 | 10/1997 |
| JP | 9262332 | 10/1997 |
| JP | 11192335 | 7/1999 |
| WO | WO 00/53275 | 9/2000 |
| WO | WO 01/00052 | 1/2001 |
| WO | WO 01/64295 | 9/2001 |

OTHER PUBLICATIONS

International Preliminary Report On Patentability, mailed Sep. 18, 2008, from PCT Application No. PCT/US2007/063509.

* cited by examiner

*Primary Examiner*—Katherine Moran
(74) *Attorney, Agent, or Firm*—Plumsea Law Group, LLC

(57) ABSTRACT

A glove with a support system is disclosed. The support system comprises a number of individual support sections, each of which is comprised of a number of arcuate support segments that encircle or surround a portion of a finger and allow forward flextural movement while helping to protect the finger. For example, the support system can help reduce hyperextension of the finger, the possibility of the finger jamming, and help to protect the finger from lateral or side impacts.

18 Claims, 17 Drawing Sheets

GLOVE WITH SUPPORT SYSTEM

BACKGROUND OF THE INVENTION

1. Field of the Invention

The present invention relates generally to protective athletic apparel and more particularly to a glove with a support system.

2. Description of Related Art

Gloves are traditionally worn to protect the hands and to improve gripping ability. Depending on the application, gloves may insulate the hands from temperature extremes, they may protect against harsh or hazardous environments, and they may protect the hands mechanically by diffusing or absorbing applied forces that would otherwise cause damage.

Protective gloves are particularly common in athletics. Most athletic gloves seek to increase gripping ability and to diffuse or absorb applied forces without interfering with the hand range of motion that is necessary for athletic tasks. Some athletic gloves seek to provide adequate hand range of motion while preventing potentially damaging movements of the hand.

One potentially damaging movement of the hand is hyperextension of the fingers. Flexion of the fingers enables the wearer to grip an object. However, if the fingers are hyperextended, i.e., straightened and pushed posteriorly, quickly or with great force, they can fracture or sustain other types of damage. Hyperextension of the fingers is a particular concern when the wearer seeks to catch an object moving at relatively high velocity.

In order to address the issue of hyperextension of the fingers, some athletic gloves include support systems that mechanically block hyperextension of the fingers. However, these athletic gloves typically inhibit flexion of the fingers.

SUMMARY OF THE INVENTION

In one aspect, the invention provides a glove including a support system, that comprises at least one support structure including a first segment and an adjacent second segment; the first segment including a first mechanical connector including at least one hole, and a second mechanical connector including at least one post; the second segment including a first mechanical connector including at least one hole, and a second mechanical connector including at least one post; where the hole of the first mechanical connector of the first segment receives the post of the second mechanical connector of the second segment thereby connecting the first segment with the second segment; where the post pivots within the hole allowing the first segment to pivot with respect to the second segment; and where the post is integrally formed on the second connector.

In another aspect, the first segment is substantially similar to the second segment.

In another aspect, the first mechanical connector of the first segment includes a pair of holes disposed on first and second end portions.

In another aspect, a central portion extends between the first and second end portions.

In another aspect, the central portion includes a first edge disposed proximal to the first mechanical connector.

In another aspect, the invention provides a glove including a support system that comprises a support structure including a first segment and an adjacent second segment; the first segment including a first mechanical connector including at least one hole, and a second mechanical connector including at least one post; the second segment including a first mechanical connector including at least one hole, and a second mechanical connector including at least one post; where the first segment is connected to the second segment and where the first and second segments present a substantially smooth outer surface when connected.

In another aspect, the first and second segments present a substantially smooth inner surface when connected.

In another aspect, the first mechanical connector of the first segment includes an outer recessed portion, the outer recessed portion including a hole.

In another aspect, the second mechanical connector of the second segment includes an inner recessed portion, the inner recessed portion including a post.

In another aspect, the outer recessed portion of the first segment generally corresponds with the inner recessed portion of the second segment.

In another aspect, the post of the second mechanical connector of the second segment is received in the hole of the first mechanical connector of the first segment thereby connecting the first segment with the second segment.

In another aspect, the post pivots within the hole allowing the first segment to pivot with respect to the second segment.

In another aspect, the post is integrally formed on the second connector.

In another aspect, the invention provides a glove comprising a first layer configured to contact a wearer's hand; a support system associated with the inner layer comprising: a support structure including a plurality of segments; the support structure having a first segment configured to pivot with respect to at least one adjacent segment; an endcap support segment including a top portion configured to protect a fingertip of the wearer's hand; and wherein the endcap support segment is attached to the first segment and can pivot with respect to the first segment.

In another aspect, the endcap includes a mechanical connector that engages a corresponding mechanical connector of the first segment.

In another aspect, the endcap includes a mechanical connector that engages a corresponding mechanical connector of the first segment.

In another aspect, the glove includes a knuckle support segment configured to protect a knuckle of the wearer, wherein the knuckle support segment is configured to associate with at least one of the plurality of segments.

In another aspect, the invention includes a glove comprising a first layer configured to contact a wearer's hand; a support system comprising a support structure including a plurality of support segments; the support structure having a first support segment configured to pivot with respect to a second support segment; and where a portion of the first support segment overlaps a portion of the second segment.

In another aspect, the first support segment axially overlaps the second support segment.

In another aspect, the first support segment is disposed distally with respect to the second support segment, and wherein the first support segment includes an angled proximal edge, and wherein the second support segment includes an angled distal edge that corresponds to the angled proximal edge of the first support segment.

In another aspect, an upper edge of the second support segment is disposed distal to a lower edge of the first support segment.

In another aspect, central portions of the first support segment and the second support segment separate when the first support segment pivots with respect to the second support segment.

In another aspect, the first support segment is connected to the second support segment by a mechanical connector that is circumferentially spaced from a central portion of the first support segment.

In another aspect, the invention includes a glove comprising a first layer configured to contact a wearer's hand; a support system comprising a support structure including a plurality of support segments; the support structure having a first support segment configured to pivot with respect to a second support segment; and where the first support segment includes a circumferentially curved portion.

In another aspect, a portion of the second support segment includes a circumferential curved portion that corresponds to the portion of the first segment that is circumferentially curved.

In another aspect, the first support segment is disposed distally with respect to the second support segment, and wherein the circumferentially curved portion of the second support segment extends axially towards the first support segment and axially distal to at least one mechanical connector of the first support segment.

In another aspect, the first support segment is connected to the second support segment by a mechanical connector that is circumferentially spaced from the circumferentially curved portion of the first support segment.

In another aspect, the invention comprises a second layer, wherein the support system is disposed between the wearer's hand and the second layer.

In another aspect, the invention includes a third layer, wherein the support system is disposed between the second layer and the third layer.

In another aspect, the support structure slides axially with respect to the second and third layer.

In another aspect, the invention includes a glove comprising a first layer configured to contact a wearer's hand; a support system disposed on the opposite side of the wearer's hand and comprising a support structure associated with a finger and including a plurality of support segments; the support structure having a first support segment configured to pivot with respect to a second support segment; and where the support structure includes an endcap support segment that is configured to be selectively engaged by the wearer's finger.

In another aspect, the endcap support segment includes an inner portion that is configured for selective engagement by the wearer's finger.

In another aspect, the proximal length of the inner portion varies circumferentially along the inner portion.

In another aspect, the support segment is indirectly moved by one or more layers of the glove when the wearer chooses to not engage the endcap support segment.

In another aspect, the invention includes a glove comprising a first layer configured to contact a wearer's hand; a support system disposed on the opposite side of the wearer's hand and comprising a support structure associated with a finger and including a plurality of support segments; the support structure having a first support segment configured to pivot with respect to a second support segment; and wherein the first support segment includes a first end portion disposed on a side of the finger configured to absorb a side impact.

In another aspect, the side impact is distributed to other support segments.

In another aspect, the side impact is distributed to an adjacent support segment.

In another aspect, the side impact causes a first gap disposed between the first support segment and an adjacent second support segment to increase.

In another aspect, the side impact causes a second gap disposed between the first support segment and the second support segment to decrease.

In another aspect, the side impact causes other gaps disposed between other adjacent support segments to increase.

In another aspect, the side impact causes other gaps disposed between other adjacent support segments to decrease.

In another aspect, the invention includes a glove comprising a first layer configured to contact a wearer's hand; a second layer and a third layer disposed on the opposite side of the wearer's hand; a support system disposed between the second layer and the third layer; and where the support system slides freely with respect to the second layer.

In another aspect, the second layer is an external layer.

In another aspect, the third layer is an internal layer disposed inside the second layer.

In another aspect, the support system slides freely with respect to the third layer.

In another aspect, the invention includes a glove comprising a support system disposed between a first layer proximate a palm of a wearer's hand and a second layer proximate a back of the wearer's hand; the support system having a first position when a finger of the wearer's hand is extended and a second position when the finger of the wearer's hand is flexed; and wherein the second position is spaced from the first position.

In another aspect, a portion of the support system is over a first position of the wearer's hand when the wearer's finger is in the extended position, and wherein the portion of the support system moves to a second position over the wearer's hand when the wearer's finger is in the flexed position.

In another aspect, the portion of the support system is a support segment.

In another aspect, the portion of the support system is a knuckle support segment.

In another aspect, the support system slides relative to the first layer.

In another aspect, the support system slides relative to the second layer.

In another aspect, the support system slides relative to the first layer and a first support segment of the support system pivots relative to a second support segment.

In another aspect, a portion of the support system remains fixed relative to the finger while the finger is being flexed.

Other systems, methods, features and advantages of the invention will be, or will become, apparent to one of ordinary skill in the art upon examination of the following figures and detailed description. It is intended that all such additional systems, methods, features and advantages be included within this description, and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
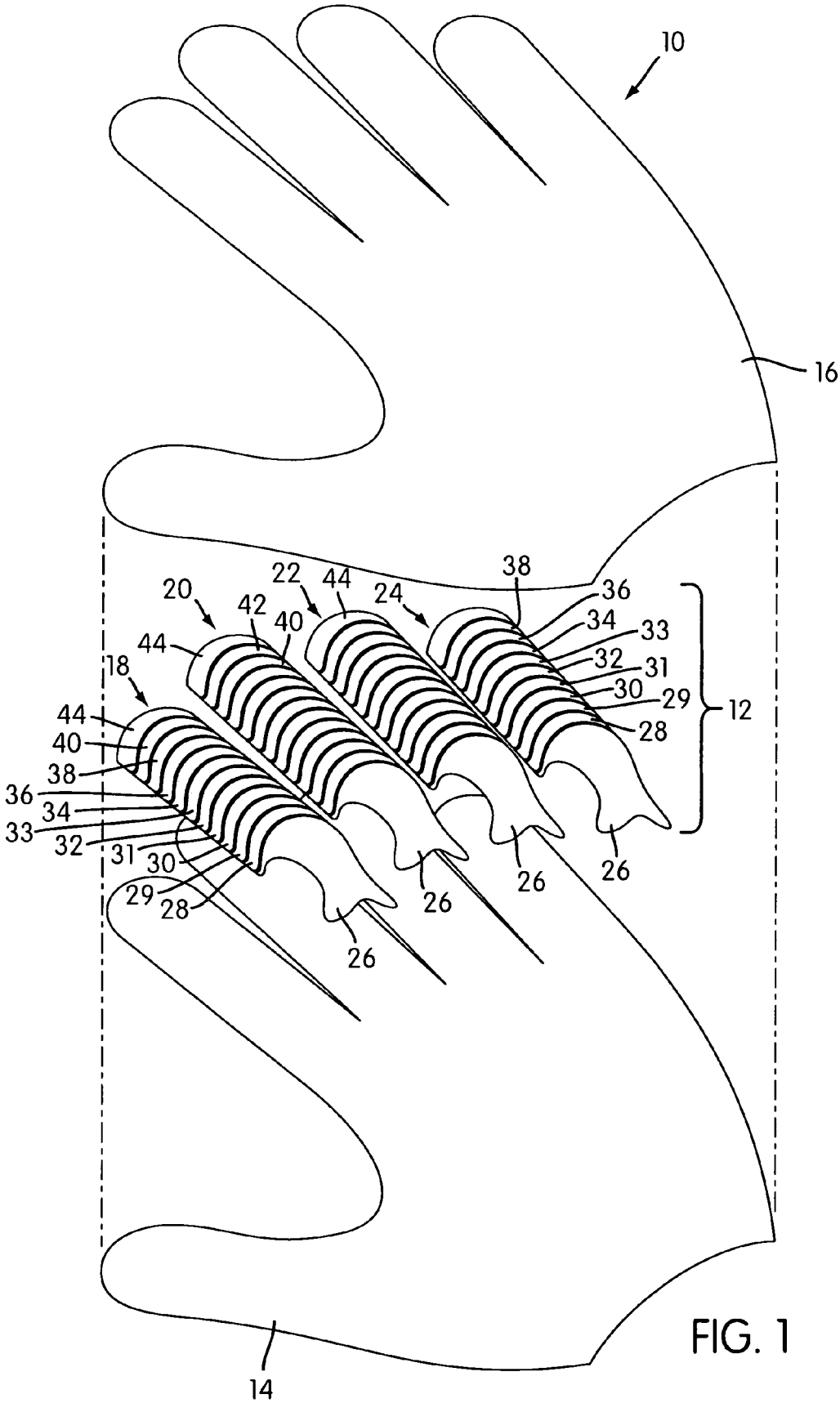
FIG. 1 is an exploded perspective view of a glove with a support system.

FIG. 1 is an exploded perspective view of a glove, generally indicated at 10, with a support system, generally indicated at 12. Glove 10 comprises at least two layers of a compliant, flexible material formed to the shape of a human hand. A first layer 14 of glove 10 is adapted to fit proximate to the anterior surface of the hand; a second layer 16 of glove 10 is adapted to fit proximate to the posterior surface of the hand. In FIG. 1, a right-handed glove is illustrated; a left-handed glove may be the mirror image of the right-handed glove.

In the description that follows, directional terms such as proximal, distal, anterior, and posterior will be used. These terms describe the orientation of glove 10 and the location of its components when glove 10 is worn on a hand, and are defined based on the standard anatomical position of the human hand.

Also, it is important to note that any feature, advantage, teaching or principle disclosed in connection with the embodiment shown in FIGS. 1-12 can be applied to any other embodiment, including but not limited to the embodiments shown in FIGS. 13-25. Likewise, any feature, advantage, teaching or principle disclosed in connection with the embodiment shown in FIGS. 13-25 can be applied to any other embodiment, including but not limited to the embodiments shown in FIGS. 1-12. The features, advantages, teachings or principles disclosed below are not strictly associated with any particular embodiment; they are described in connection with a given embodiment to provide clarity and context. Additionally, all of the features, advantages, teachings or principles are optional and need not be used on every embodiment. Some embodiments may include only a single feature, while others may include several or all of the features.

In preferred embodiments, glove 10 is adapted for use as an athletic glove. In one particular preferred embodiment, glove 10 is adapted for use as a soccer goalie glove. Preferably, at least first layer 14 of glove 10 is adapted to increase tactility and gripping ability. Both first and second layers 14, 16 of glove 10 may, for example, be made of leather, synthetic leather, soft PVC, or nylon. First and second layers 14, 16 may also include pockets of foam or other cushioning material that absorb force and increase gripping ability. Depending on the embodiment, the materials of first layer 14 and second layer 16 may be the same or different. Additionally, in some embodiments, the layers and features of a left-handed glove may be different than the layers and features of a right-handed glove, depending on the application.

Support system 12 is disposed between first and second layers 14, 16 of glove 10, and may be secured between first and second layers 14, 16 in any desired manner. For example, support system 14 may be sewn into place between first and second layers 14, 16. Moreover, although not shown in FIG. 1, additional layers of fabric or other material may be sewn, fused to, or otherwise mounted on or between first and second layers 14, 16 in order to define pockets for support system 12.

Support system 12 comprises a plurality of support structures 18, 20, 22, 24, one for each of the four fingers on the hand. In the illustrated embodiment, no support structure is provided for the thumb, although a support structure could be included in other embodiments. Support structures 18, 20, 22, 24 are positioned within glove 10 such that when glove 10 is worn, each support structure 18, 20, 22, 24 extends from a proximal location adjacent the first knuckle to a distal location adjacent the tip of the finger.

Each support structure 18, 20, 22, 24 is sized for the particular finger that it is to support, and each comprises the following optional components: a proximal knuckle support segment 26, at least one middle support segment, preferably a plurality of middle support segments 28, 29, 30, 31, 32, 33, 34, 36, 38, 40, 42 connected to each other, and a distal endcap support segment 44. In order to accommodate longer finger length, those support structures 18, 20, 22, 24 that are adapted for longer fingers may have more middle support segments 28, 29, 30, 31, 32, 33, 34, 36, 38, 40, 42. The interconnection and manner of operation of support structures 18, 20, 22, 24 will be described in more detail below. Preferably, support segments 26, 28, 29, 30, 31, 32, 33, 34, 36, 38, 40, 42, 44 are made of a material having sufficient rigidity for the application. In some preferred embodiments, support segments 26, 28, 29, 30, 31, 32, 33, 34, 36, 38, 40, 42, 44 are made of a plastic, such as high density polyethylene (HDPE). In other embodiments, support segments 26, 28, 29, 30, 31, 32, 33, 34, 36, 38, 40, 42, 44 may be made of metal.

In general, support structures 18, 20, 22, 24 of glove 10 are adapted to prevent hyperextension of the fingers while allowing a full range of motion in flexture. As the term hyperextension is used here, it refers generally to any unwanted posterior (i.e., rearward) movement or position of any portion or joint of a finger, as well as specific positions that may be clinically described as hyperextended. It should be understood that one joint of a finger may be hyperextended even though other joints of that same finger are flexed.

Figure 2:
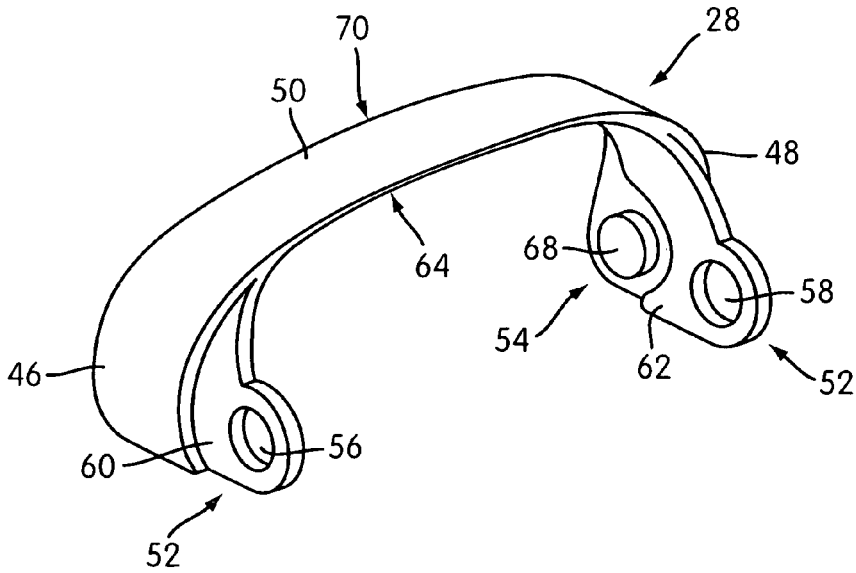
FIG. 2 is a top perspective view of a support segment of the support system of FIG. 1.
Figure 3:
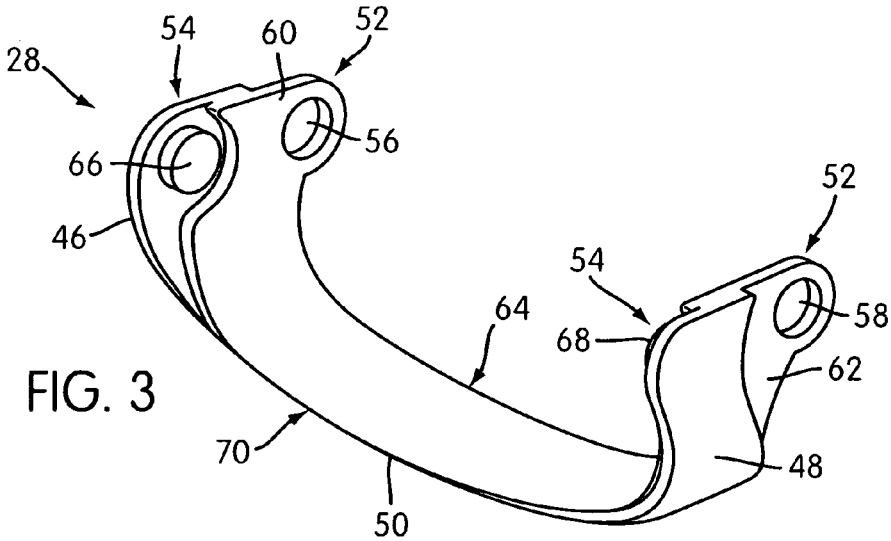
FIG. 3 is a bottom perspective view of the support segment of FIG. 2.

FIG. 2 is a top perspective view of one of middle support segments 28, 29, 30, 31, 32, 33, 34, 36, 38, 40, 42 in isolation, and FIG. 3 is a bottom perspective view. Although the middle support segments 28, 29, 30, 31, 32, 33, 34, 36, 38, 40, 42 may differ slightly in size or shape so as to be adapted for the various fingers or for a particular position along the finger, preferably, they are of substantially the same shape and size; therefore, for clarity, details of support segment 28 illustrated in FIGS. 2 and 3 are disclosed, keeping in mind that the teachings of support segment 28 can be applied to the other support segments 29, 30, 31, 32, 33, 34, 36, 38, 40, 42.

Support segment 28 has a generally arcuate shape, and is adapted to curve laterally around the finger that it is to support. In the illustrated embodiment, support segment 28 has curving first and second end portions 46, 48 connected by a relatively flat central portion 50. When glove 10 is worn, one of end portions 46, 48 extends around the medial aspect of the finger and the other end portion 46, 48 curves around the lateral aspect of the finger. In a preferred embodiment, support segment 28 extends over approximately 180° of the circumference of the finger, although greater and lesser extents are possible.

Each of the first and second end portions 46, 48 has a first mechanical connector 52 and a second mechanical connector 54. With respect to the anatomical coordinate system of the fingers, first mechanical connector 52 is configured to associate support segment 28 with a more distal support segment 29; second mechanical connector 54 is configured to associate support segment 28 with a more proximal support segment 26.

First mechanical connector 52 comprises first and second holes 56, 58 defined opposite one another in respective outwardly extending first and second connecting portions 60, 62. First and second connecting portions 60, 62 project distally from support segment 28 and arise as first and second end portions 46, 48 merges into central portion 50. As is shown in the figures, first and second connecting portions 60, 62 are slightly recessed so as to lie inwardly of a first edge 64 of support segment 28. First edge 64 of support segment 28 acts as the outermost edge of support segment 28 distally; its contours will be described in greater detail below.

Second mechanical connector 54 comprises first and second posts 66, 68 positioned opposite one another on opposite inwardly oriented faces of first and second end portions 46, 48. First and second posts 66, 68 are sized to fit within and cooperate with the respective first and second holes 56, 58 of an adjacent support segment and to extend inwardly so as to be flush with the respective first and second connecting portions 60, 62 when engaged in first and second holes 56, 58. Adjacent first and second posts 66, 68 is a second edge 70, which acts as the proximal outermost edge of support segment 28.

Figure 4:
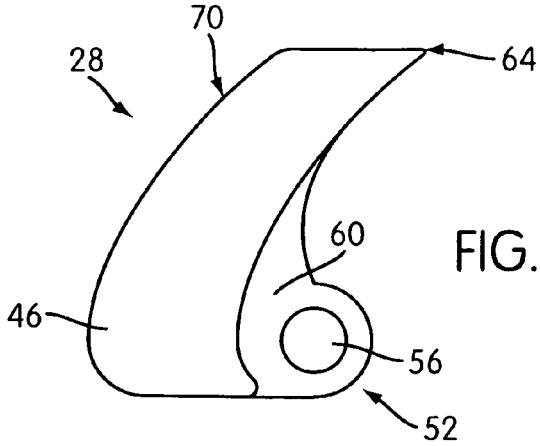
FIG. 4 is a side elevational view of the support segment of FIG. 2.

FIG. 4 is a side elevational view of the support segment 28. As shown in FIG. 4, with respect to the coordinate system of the hand, central portion 50 and its first edge 64 extend farther in a distal direction than first and second posts 66, 68. The overall curvature of central portion 50 and the extent of its first and second edges 64, 70 can also be seen in FIGS. 7 and 8, which are, respectively, top and bottom plan views of support segment 28.

Preferably, the second support segments are designed with shapes that help to provide a strong and interlocking engagement when two adjacent segments contact one another. Preferably, the shapes of adjacent segments provide those segments with the ability to contact and interact with one another along adjacent edges. This arrangement can help to increase the rigidity of each of the support structures 18, 20, 22, 24, and the overall rigidity of support system 12.

Figure 5:
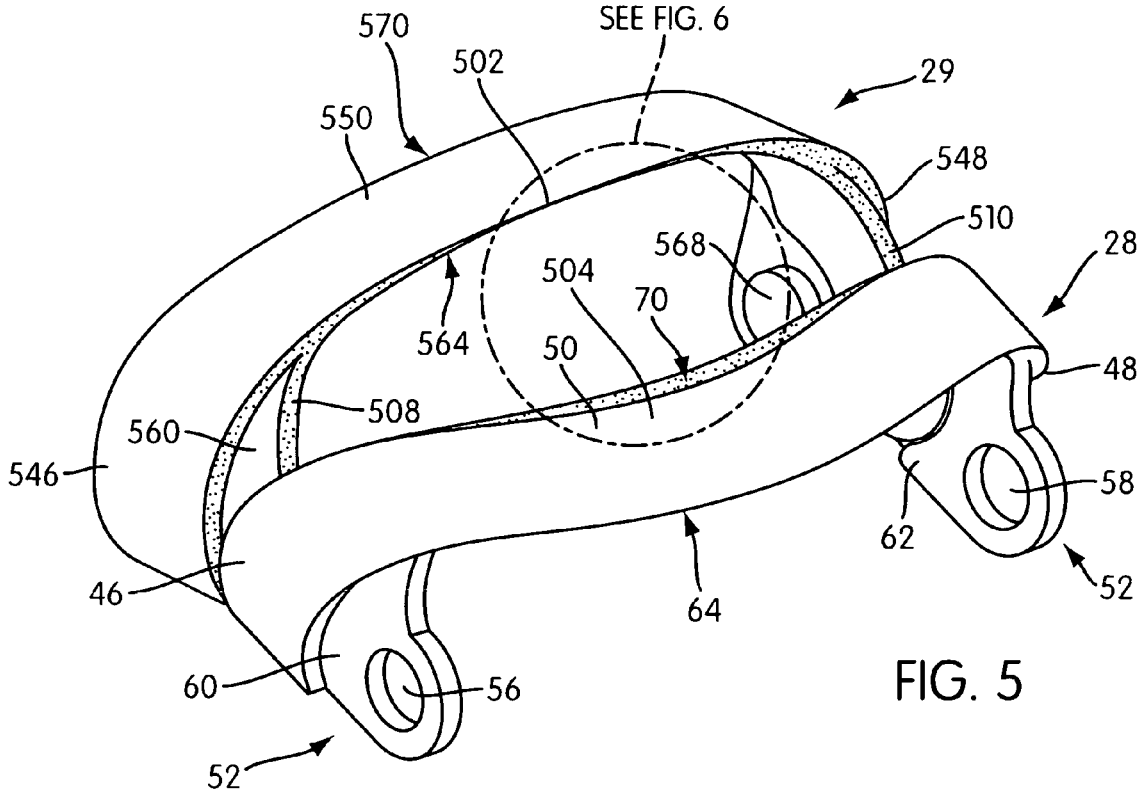
FIG. 5 is a perspective view of two interconnected support segments.
Figure 6:
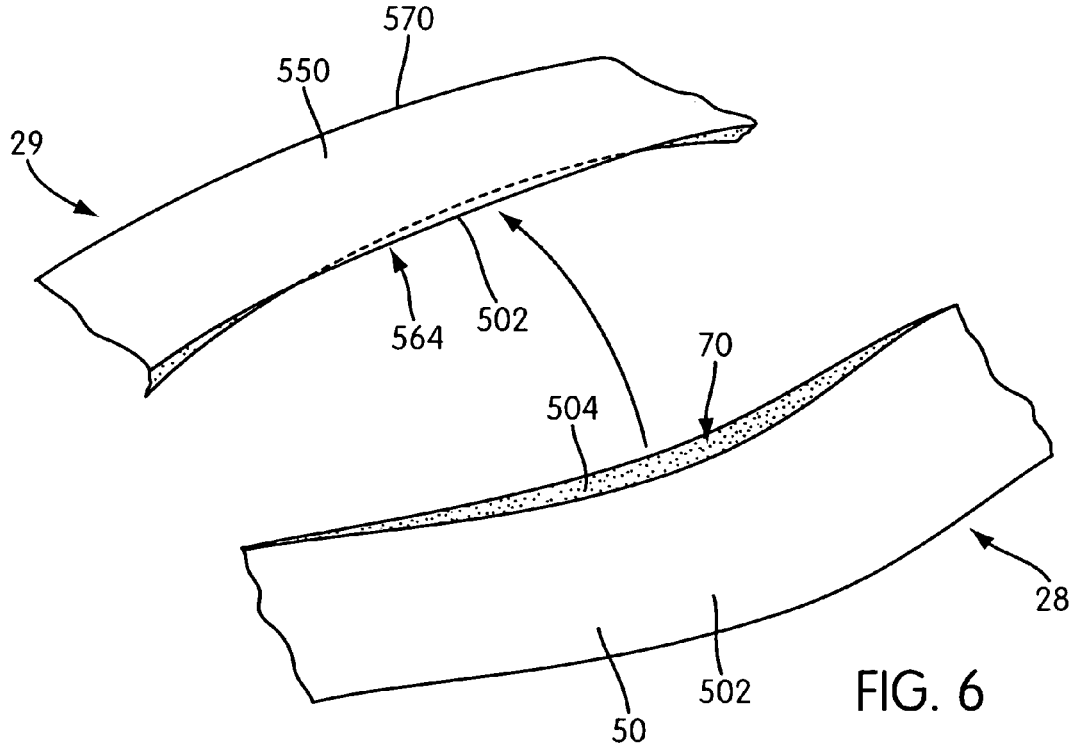
FIG. 6 is a magnified perspective view of a portion of the two interconnected support segments of FIG. 5.
Figure 7:
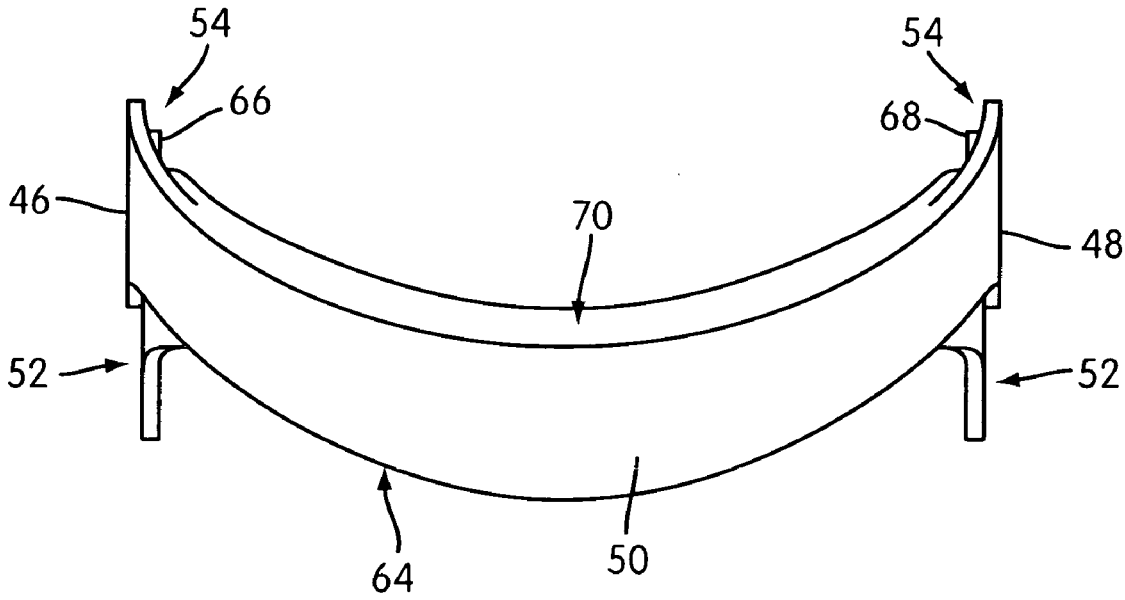
FIG. 7 is a top plan view of the support segment of FIG. 2.
Figure 8:
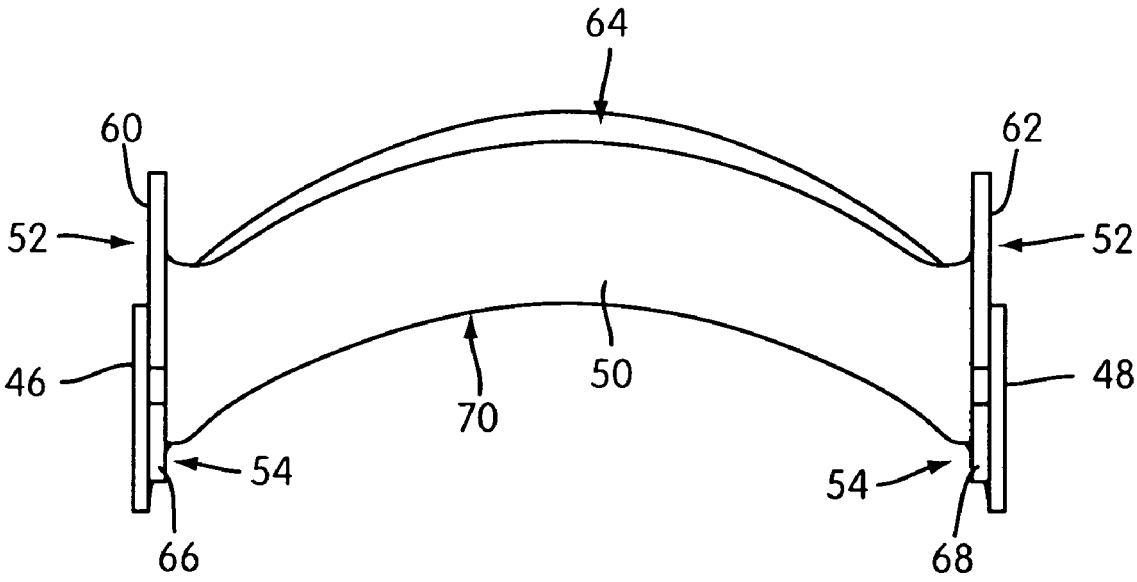
FIG. 8 is a bottom plan view of the support segment of FIG. 2.

FIG. 5 is a perspective view showing two interconnected support segments, first segment 28 and second segment 29, and FIG. 6 is a magnified perspective view of a portion of FIG. 5, illustrating the central portions of those segments. First and second segments 28 and 29, are representative of other support segments 30, 31, 32, 33, 34, 36, 38, 40, 42 in their curvature, contact surface area, and in the way one segment interacts with an adjacent segment. The following principles, features and teachings related to first segment 28 and second segment 29 can be applied to any other pair of adjacent segments.

As described above, first segment 28 includes first and second end portions 46 and 48 that extend from central portion 50. First segment 28 also includes a distal edge 64 and a proximal edge 70. Distal edge 64 is preferably disposed further away from the wearer than proximal edge 70. Similarly, second segment 29 includes first and second end portions 546 and 548 that extend from central portion 550. Like first segment 28, second segment 29 also includes a distal edge 564 and a proximal edge 570.

The following features help to improve the interlocking rigidity of the two segments 28 and 29. Preferably, the central portion 50 of first segment 28 is curved or bowed circumferentially in a distal direction, away from the wearer. The term "circumferentially" here refers to a hypothetical cylindrical coordinate system formed about the wearer's finger. The axial direction would extend along the length of the finger. The radial direction would extend from the central axis of the finger outwards, and the circumferential direction would extend around the finger, like a ring. To be curved or bowed in a circumferential direction means that the support segment has some portion that includes a shape that varies from a straight ring shape around the finger.

The circumferential curvature of support segment 28 can be observed in FIGS. 5-8. Central portion 50, defined by proximal edge 70 and distal edge 64, emerges from first and second end portions 46 and 48, and is circumferentially curved distally (away from the wearer's hand and towards the fingertips). The bow-shaped circumferential curves of proximal edge 70 and distal edge 64 can also be observed. The circumferential curvature of central portion 50 can be considered by comparing the shape of central portion 50 with a hypothetical ring, which would extend straight across, but arced around the finger, from first end portion 46 to second end portion 48. Because central portion 50, as defined by proximal edge 70 and distal edge 64, is curved in a circumferential direction, the shape of central portion 50, as well as proximal edge 70 and distal edge 64 varies from the hypothetical ring.

Preferably, second segment 29 includes a matching curved of bowed shape. Thus, central portion 550 of second segment 29 is also curved or bowed in a distal direction, with a curve that matches the curve of first segment 28. Likewise, proximal edge 570 and distal edge 564 of second support segment 29 are also preferably curved in a circumferential direction in a manner similar to proximal edge 70 and distal edge 64, respectively, disclosed above.

As opposed to being straight, this curved central portions 50 and 550 dramatically increase the contact area between first segment 28 and second segment 29. This curved shape also helps to increase the stiffness of the two segments 28 and 29 in a variety of different ways. First, the curved central portions 50 and 550 form an interlocking system where the central edge portion 502 (of second segment 29) of distal edge 564 is received by the central edge portion 504 (of first segment 28) of proximal edge 70. This arrangement forms a system roughly analogous to a key and keyway. The protrusion of central edge portion 502 into central edge portion 504 acts like a key entering a keyway. This helps to securely lock second segment 29 with first segment 28.

Figure 22:
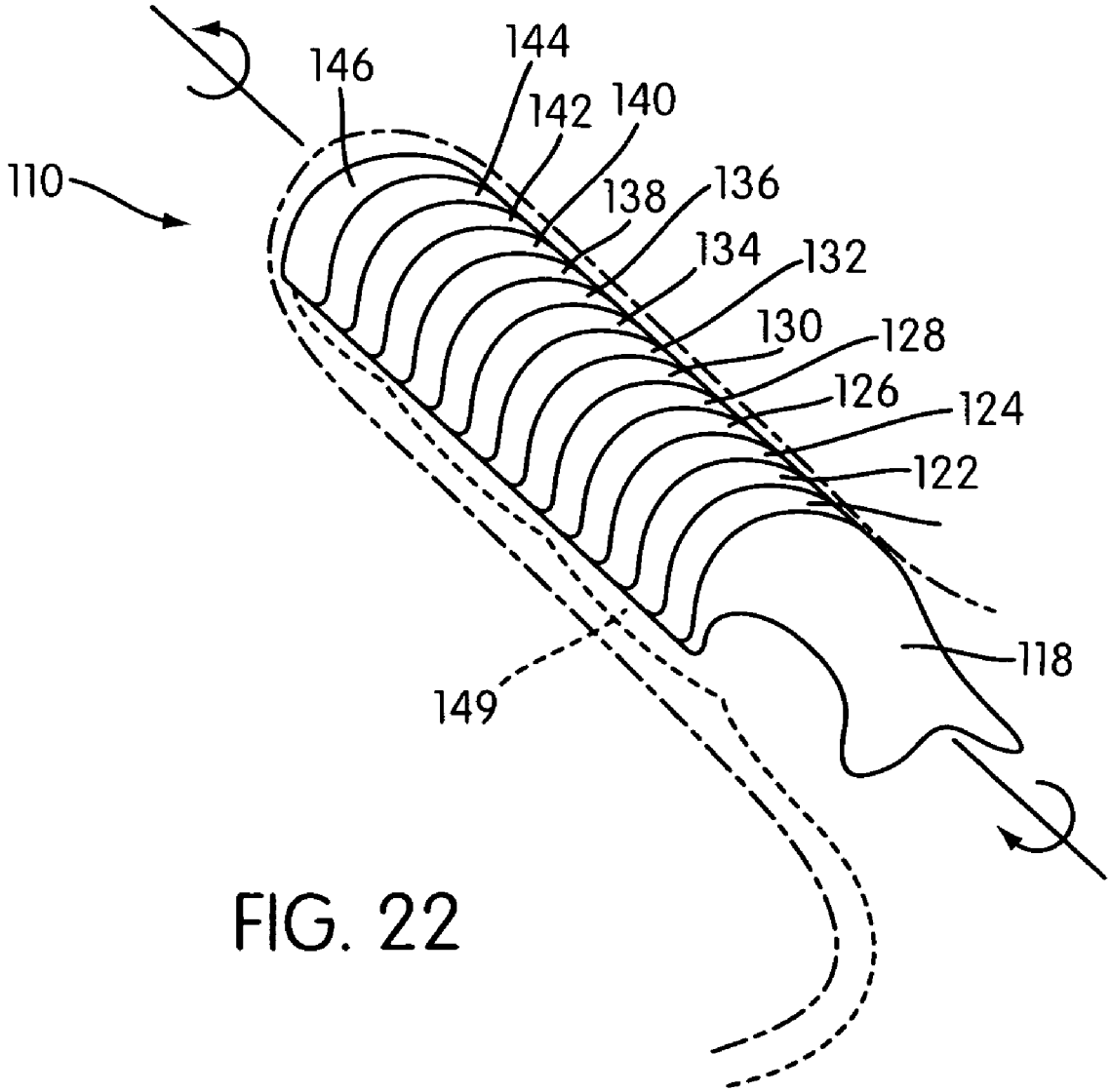
FIG. 22 is a schematic perspective view of a support structure, illustrating its resistance to torsional forces.

This arrangement also helps to dramatically improve the torsional rigidity of the support system. Torsional rigidity is related to a system's ability to resist twisting, as shown in FIG. 22. The preferred curved and interlocking system would be inherently more rigid in torsion than a system with straight segments that extended circumferentially across the wearer's finger without curving. Without the curved central portions, the straight confronting edges of the two adjacent segments would simply slide with respect to one another. The only thing that would prevent torsional twisting would be the connecting holes and posts.

In a similar way, the circumferentially curved shape helps to increase the strength of the support system in other directions or loading conditions as well. The circumferentially curved shape and the overall shape of the support segments helps to improve the strength of support structures 18, 20, 22 and 24 in axial loading (see FIG. 23), bending, and in lateral deflection (see FIGS. 24 and 25). These improved strength characteristics of these different modes is described in greater detail below in connection with their respective Figures.

In addition to the way the interlocking feature contributes to the strength of a support structure, the increased surface area that results from the curved shape also contributes to the increased strength and rigidity of the support structure. The circumferential curve increases the contact area, which is shown in shading 510, between adjacent segments 28 and 29. Adjacent curved segments would obviously provide an increased contact area 510 over adjacent segments that were circumferentially straight (ring-shaped). This increase in surface area helps to distribute any load experienced by one support segment to its adjacent support segments. This increase in surface area helps to improve the strength of the support system in axial loading, bending, and many other directions or applications of force. These different modes are disclosed below in greater detail.

Some embodiments include additional features to further increase the contact surface area 510 between adjacent segments 28 and 29. In one preferred embodiment, the proximal and distal edges are angled as opposed to being flat. As shown in FIGS. 4-6, 9 and 10, proximal edge 70 and distal edge 64 of first segment 28 is angled. Similarly like first support segment 29, second support segment 29 can also include angled proximal edge 570 and distal edge 564. This angle can be observed in FIGS. 4 and 10. Regarding first support segment 28, first or proximal edge 64 can be angled (as opposed to being vertically straight) and second or distal edge 70 can also be angled (as opposed to being vertically straight). This angle also helps to increase the surface area contact 510 of the first and second segments 28 and 29, and also contributes to the ability of those segments 28 and 29 to interlock with one another.

Figure 9:
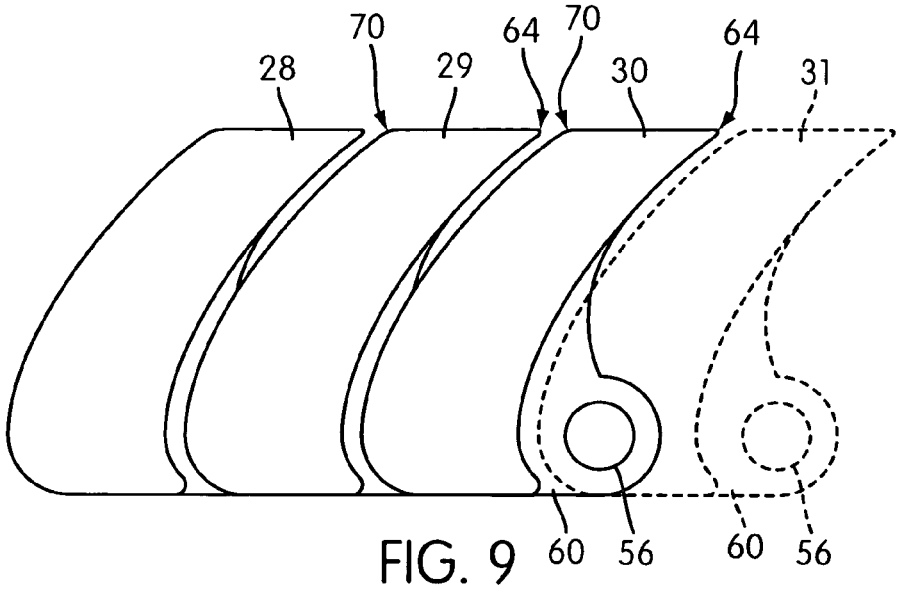
FIG. 9 is a side elevational view of several support segments, illustrating their interconnection.
Figure 10:
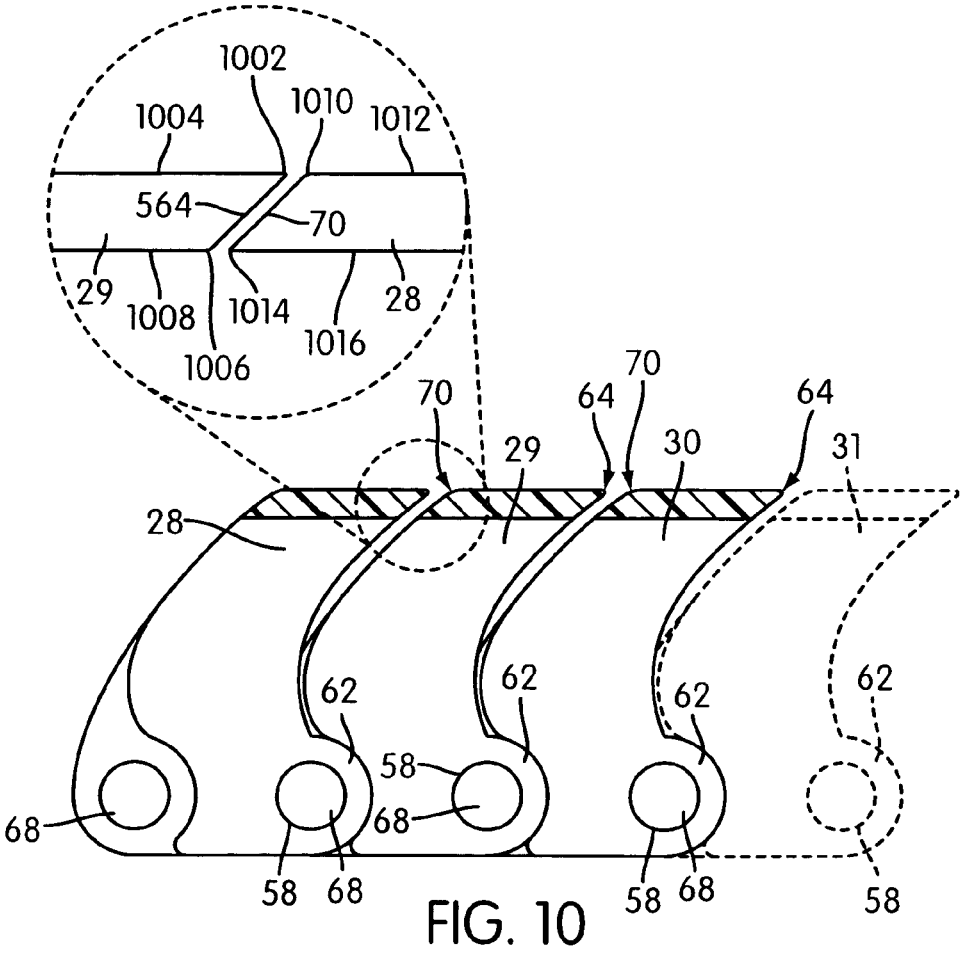
FIG. 10 is a cross-sectional view of the support segments including an enlarged portion.

This interlocking can be observed in FIGS. 5, 6, 9 and particularly, FIG. 10. Referring to FIG. 10, central edge portion 502 of second support segment 29 includes upper surface 1004 and lower surface 1008. Upper surface 1004 terminates with upper edge 1002 and lower surface 1008 terminates with lower edge 1006. Preferably, the angled distal edge 564 of second support segment 29 causes upper edge 1002 to be located axially distal with respect to lower edge 1006.

Preferably, central portion 504 of first support segment 28 includes a corresponding angled edge. In the embodiment shown in FIG. 10, proximal edge 70 of first support segment 28 includes upper surface 1012 and lower surface 1016. Upper surface 1012 terminates with upper edge 1010 and lower surface 1016 terminates with lower edge 1014. Preferably, the angled proximal edge 70 of first support segment 28 causes upper edge 1010 to be located axially proximal with respect to lower edge 1014.

Notice that the angled central edge portion 502 of second segment 29 is able to rest on top of the angled central edge portion 504 of first segment 28. In other words, upper edge 1002 of second support segment 29 is located distal of lower edge 1014 of first support segment 28. As shown in FIG. 10, a portion of second support segment 29 overlaps a portion of first support segment 28, and vise versa. The preferred embodiment shows an axial overlap, but this overlap can occur in other dimensions as well.

This overlapping helps the two adjacent segments 28 and 29 maintain alignment and remain at similar radial positions. Without their respective angled central edge portions, the two adjacent segments 28 and 29 could slide in a radial direction with respect to one another. The angled edges and overlap the angled edges provide help to interfere with free radial motion between adjacent segments 28 and 29.

Considering both the increases in surface area from the circumferentially curved shape and the angled proximal and distal edges, the total surface area of the contacting surfaces in support segments 28 and 29 can be observed in FIG. 5, where the area of contact is indicated with shading. As shown in FIG. 5, all of the various curves and angled edges in support segments 28 and 29 increases the contact surface area of the two support segments 28 and 29 relative to what that contact area would be if the shape and edges of support segments 28 and 29 were straight and flat.

The total contact surface area includes at least the overall curved area of first and second edges 64, 70, area created by areas of concavity and convexity 502, 504 in central portions 50, and the area of bifurcated edge portions 508, 510 created by the positioning of first and second connecting portions 60, 62. The increased contact area between segments 28 and 29 has the general effect of diffusing mechanical loads over larger areas, thereby reducing mechanical stresses on the parts. The response of interconnected segments to particular mechanical loads will be described in more detail be low.

When support segments 28 and 29 are in full contact, that contact occurs along substantially their entire proximal and distal edge faces. Moreover, despite the various curvatures present in both segments, the association of segments 28 and 29 is such that their inner and outer surfaces are generally co-planar when they are in full contact and engagement with one another.

FIGS. 5 and 6 illustrate one particular embodiment of support segments 28 and 29. In other embodiments, the curvatures given to a particular support segment may be different. The complex curvature of other embodiments of a support segment may be any curvature that facilitates the interaction disclosed above. Although there are no particular limitations on the amount or type of curves or angles that can be applied to a support segment, it is preferable that support segments are formed so as to include an irregular shape (either angle or curve) in more than one plane or direction.

The connection of one support segment 30 with proximal support segments 28, 29 and a distal support segment 31 are shown in FIGS. 9 and 10. As shown, first posts 66 engage with first holes 56 and second posts 68 engage with second holes 58 to connect support segments 28, 29, 30, 31. Because of the position of first and second mechanical connectors 52, 54, support segments 28, 29, 30, 31 overlap and are partially nested within one another once connected, with first and second mechanical connectors 52, 54 positioned on the interior.

Figure 11:
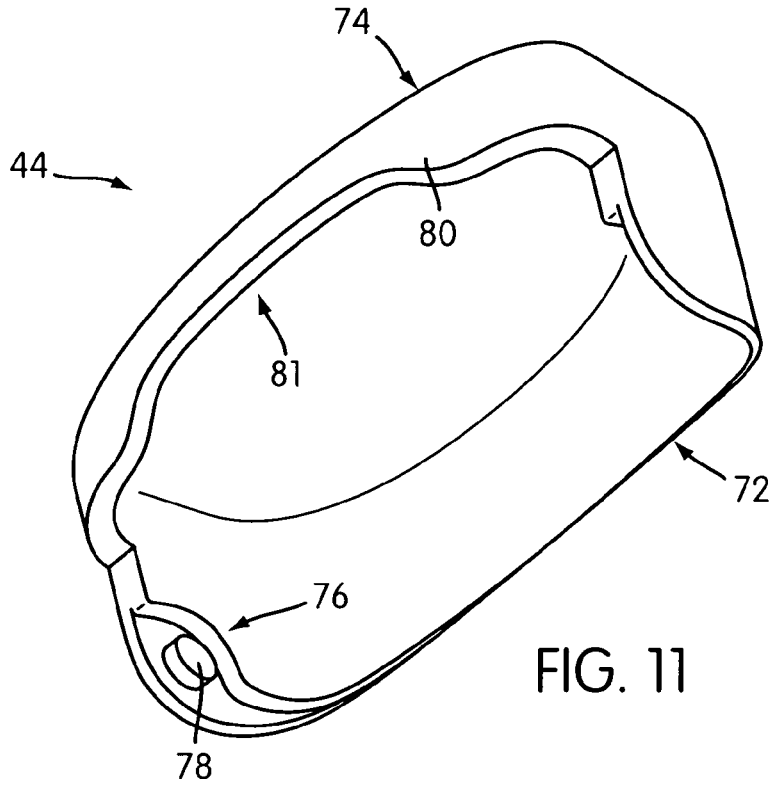
FIG. 11 is a perspective view of a distal cap support segment of the support system.

As was described above, support structures 18, 20, 22, 24 may have distal endcap support segments 44. FIG. 11 is a perspective view of an endcap support segment 44 in isolation. Endcap support segment 44 has a generally cup-like structure and includes a surrounding portion 72 and a top portion 74. Surrounding portion 72 is contoured to match the contours of middle segments 28, 29, 30, 31, 32, 33, 34, 36, 38, 40, 42 to which it is attached and with which it cooperates. An endcap mechanical connector 76 comprises a first endcap post 78 and a second endcap post (not shown in the view of FIG. 11). First endcap post 78 and second endcap post are slightly recessed with respect to the interior surface of endcap support segment 44 and are sized to engage and cooperate with corresponding first and second holes 56, 58 of support segments 28, 29, 30, 31, 32, 33, 34, 36, 38, 40, 42 such that the tops of first post 78 and second post are flush with the interior surface of endcap support segment 44 when engaged with another segment 28, 29, 30, 31, 32, 33, 34, 36, 38, 40, 42.

Top portion 74 is adapted to protect the fingertip and includes an inner portion or anterior edge 80 that extends proximally from top portion 74 and helps to retain the fingertip within endcap support segment 44. This inner portion 80 can also be configured so that the wearer can selectively engage endcap support segment 44. This feature is disclosed in greater detail below.

Figure 12:
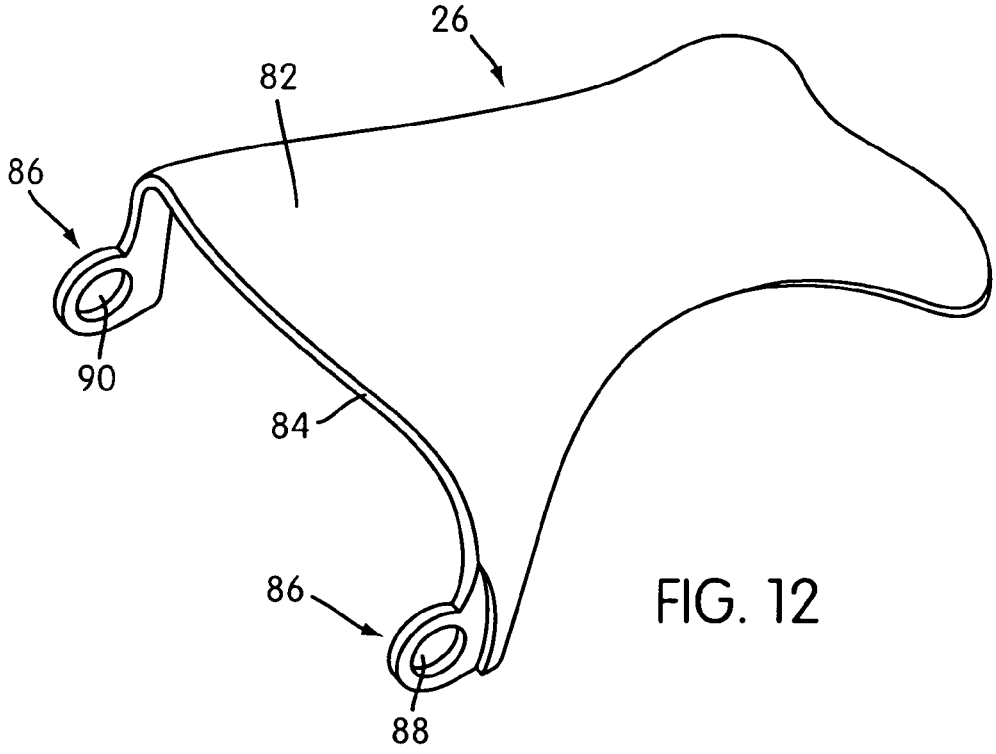
FIG. 12 is a perspective view of a proximal knuckle guard support segment of the support system.

FIG. 12 is a perspective view of proximal knuckle support segment 26. The knuckle support segment 26 includes a broad portion 82 that terminates distally in a distal edge 84. Broad portion 82 and distal edge 84 are sized and contoured to cooperate and engage with distal segments 28, 29, 30, 31, 32, 33, 34, 36, 38, 40, 42. Broad portion 82 also includes a knuckle support segment mechanical connector 86 which comprises first and second holes 88, 90 defined in first and second projecting portions 92, 94 that extend relatively inwardly from the outermost edge of broad portion 82 and are positioned so as to engage first and second posts 66, 68.

Broad portion 82 narrows proximally from distal edge 84 and curves arcuately inwardly, giving knuckle support segment 26 the overall shape of a "fish tail," as illustrated in FIG. 12. The curvature allows knuckle support segment 26 to protect the knuckle without obstructing flextural movement or interfering with other nearby knuckle support segments 26 from other fingers.

Figure 13:
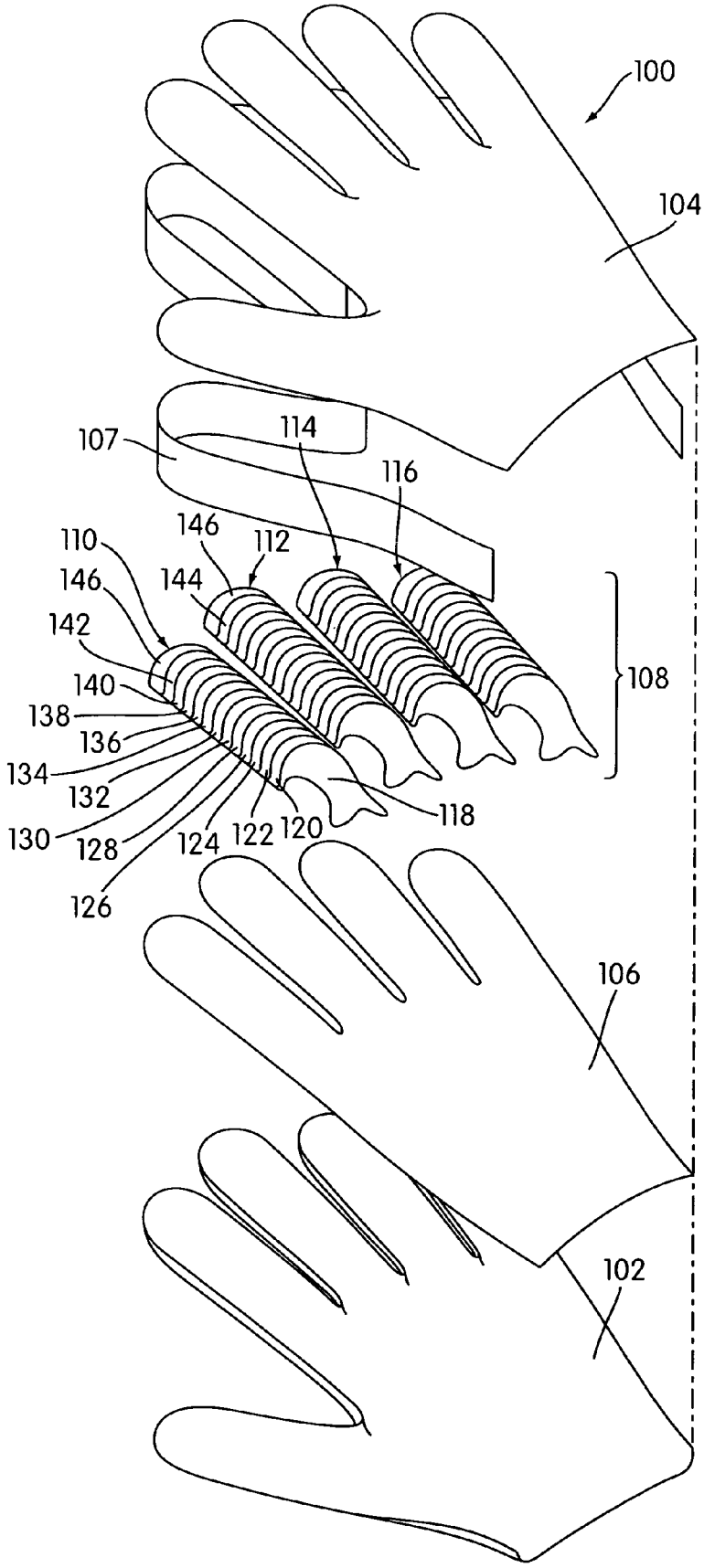
FIG. 13 is a perspective view of a glove with a support system according to another embodiment of the invention.

FIG. 13 is a perspective view of a glove, generally indicated at 100, with a support system 108 according to another embodiment of the invention. Glove 100 is similar in many respects to glove 10, and thus, those aspects of glove 100 that are not described in specific detail may be assumed to be similar to those of glove 10. Glove 100 is a right-handed glove; left handed gloves would typically be mirror images of glove 100.

Glove 100 includes several layers of fabric, a first layer 102, a second layer 104, a third layer 106 intermediate the first and second layers 102, 104 and a layer of gusset material 107 between the second and third layers 104, 106. As with glove 10, first layer 102 of glove 100 is adapted to fit proximate to the anterior of the hand. Each of the layers 102, 104, 106 may comprise several layers of the same or different material. For example, each layer 102, 104, 106 may comprise a relatively soft inner layer of fabric and leather or synthetic leather layers or portions on the outside so as to increase tactility and grip. The layers 102, 104, 106 may also include layers of various foams, including latex foams and synthetic foams. The layer of gusset material 107 may be comprised of nylon or another soft, flexible fabric.

Third layer 106 of glove 100 is preferably relatively thin compared to first and second layers 102, 104 and is adapted to be sewn, fused, or otherwise attached between first and second layers 102, 104 to form a series of pockets. Support system 108 is adapted to rest and glide freely within the pockets. Support system 108, which is similar in many respects to support system 12 of glove 10, includes four support structures 110, 112, 114, 116, one for each of the fingers. Correspondingly, third layer 106 is shaped so as to create four pockets for four support structures 110, 112, 114, 116. Each support structure 110, 112, 114, 116 includes a knuckle support segment 118, a plurality of intermediate support segments 120, 122, 124, 126, 128, 130, 132, 134, 136, 138, 140, 142, 144 and an endcap support segment 146.

Figure 14:
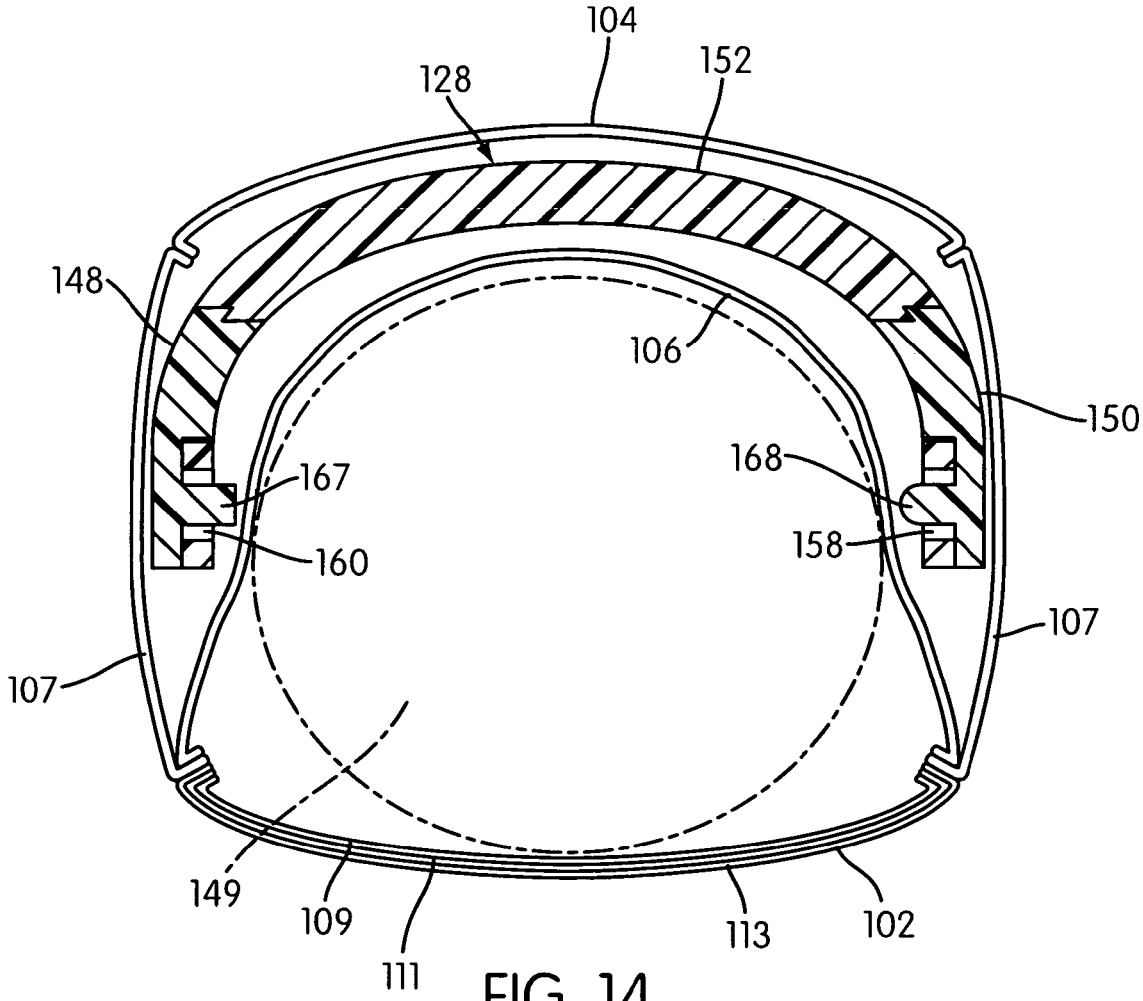
FIG. 14 is a sectional view of the glove of FIG. 13, taken through Line 14-14 of FIG. 19 and illustrating one finger of the glove.
Figure 19:
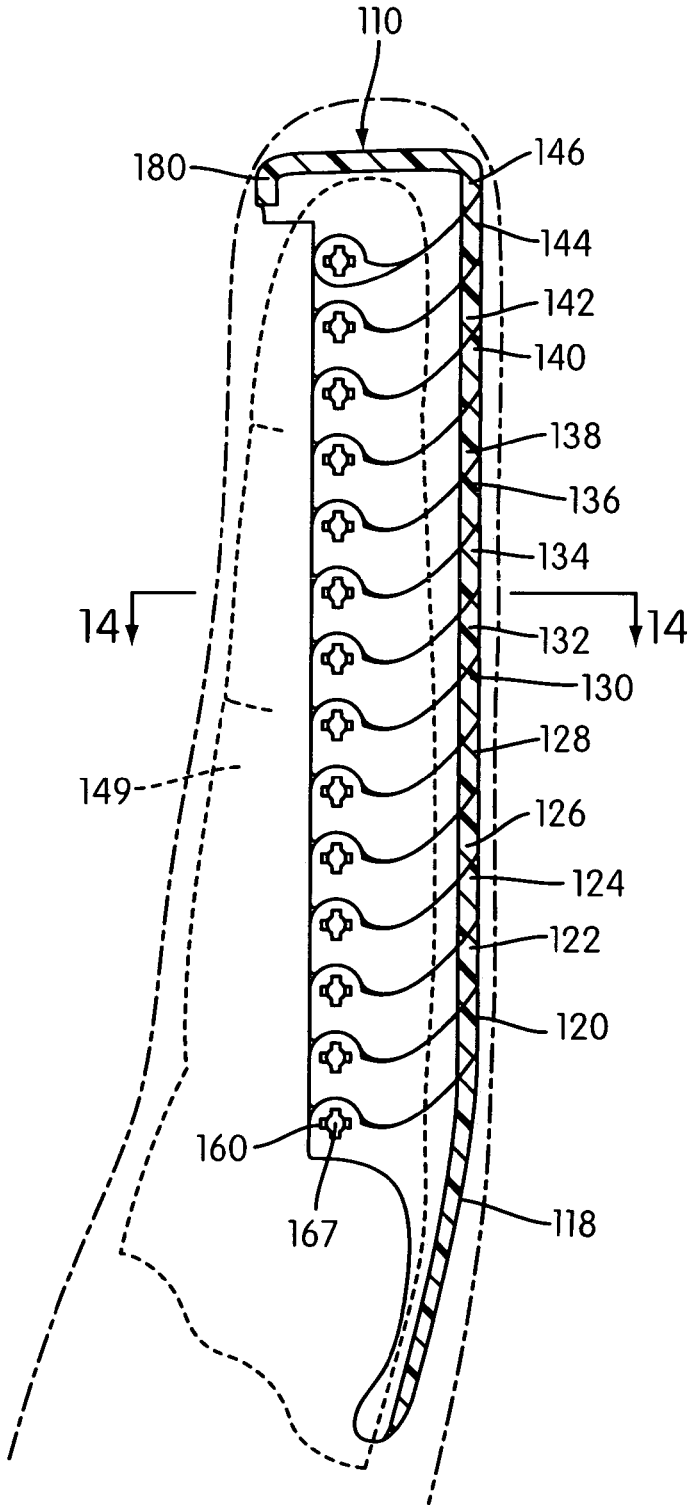
FIG. 19 is a side elevational sectional view of one finger of the glove of FIG. 13, illustrating a support structure in the extended position.

FIG. 14 is a sectional view of glove 100 taken through Line 14-14 of FIG. 19, illustrating a finger 149 in phantom as it would appear in place inside glove 100. First, second, and third layers 102, 104, 106 are joined by gusset material layer 107. Gusset material layer 107 gives glove 100 sufficient height to accommodate a hand and support system 108. As shown in FIG. 14, first layer 102 is itself preferably comprised of three layers, an inner layer of nylon or other thin, flexible, absorbent material 107, a layer of additional foam 111, and a layer of latex foam 113 which acts as the outer layer and increases the ability of glove 100 to catch and grip. Portions of the outer surface of either of first layer 102 or second layer 104 may be provided with pieces of leather or synthetic leather.

Support structures 110, 112, 114, 116 of support system 108 are disposed between second layer 104 and third layer 106. Specifically, FIG. 14 illustrates one intermediate support segment, generically indicated at 128 and representative of the features of all of the intermediate support segments, in section, disposed between second layer 104 and third layer 106 and encircling approximately 180° of the circumference of finger 149.

As is also shown FIG. 14, support segment 128 is disposed between second and third layers 104, 106 but, preferably, neither support segment 128 nor any other portion of support structures 110, 112, 114, 116 is secured in place between those two layers 104, 106. Thus, support structures 110, 112, 114, 116 are free to move along a proximal-distal line of motion within the pocket created by second layer 104 and third layer 106. In other embodiments, support structures 110, 112, 114, 116 may be secured in place between second layer 104 and third layer 106. However, leaving support structures 110, 112, 114, 116 free to move has certain advantages that will be described in greater detail below.

Figure 15:
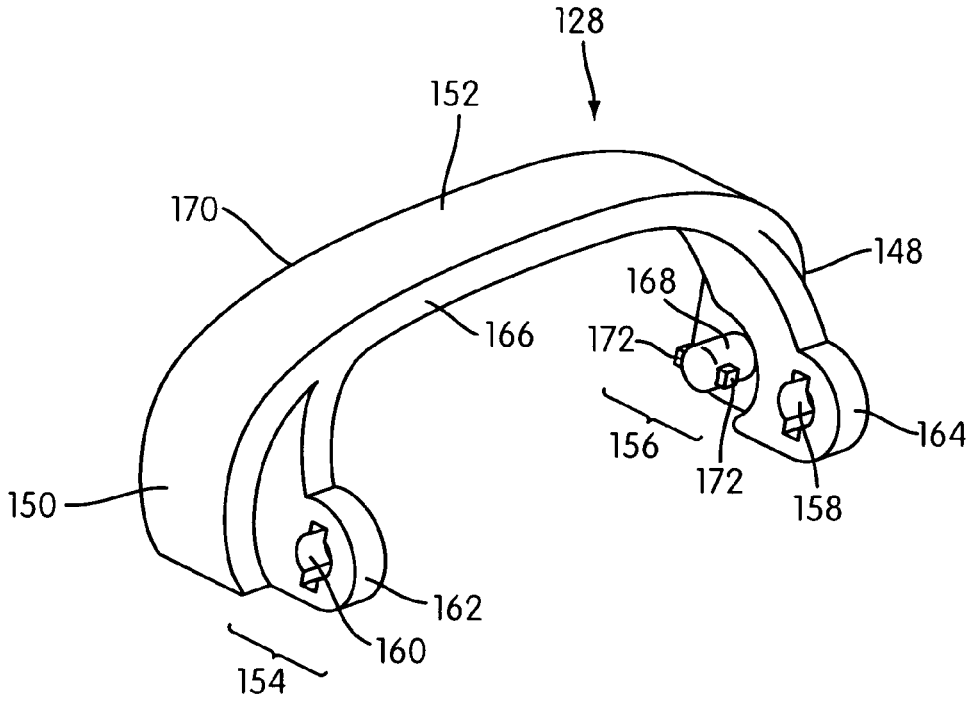
FIG. 15 is a perspective view of one intermediate support segment of the glove of FIG. 13.
Figure 16:
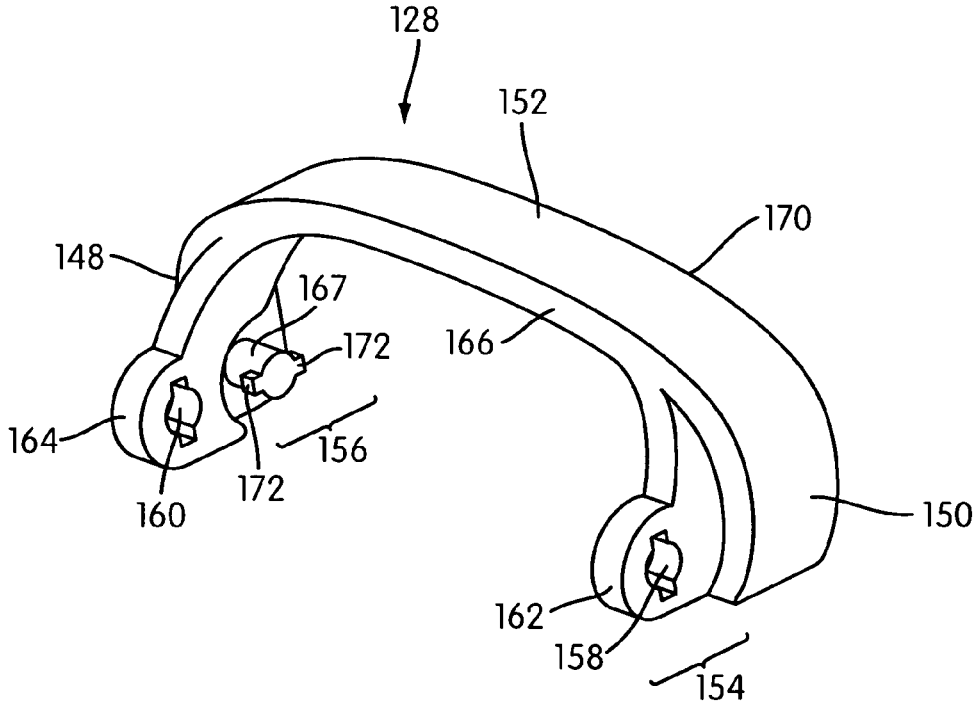
FIG. 16 is another perspective view of the intermediate support segment of the glove of FIG. 13.

FIGS. 15 and 16 are perspective views of the generic intermediate support segment 128, which is representative of the features of the other intermediate support segments 120, 122, 124, 126, 130, 132, 134, 136, 138, 140, 142, 144. Support segment 128 has a general shape and features similar to those of support segment 28, including first and second end portions 148, 150 connected by a relatively flat central portion 152. When glove 100 is worn, one of end portions 148, 150 extends around the medial aspect of finger 149 and the other end portion 148, 150 curves around the lateral aspect of finger 149, as illustrated in FIG. 14. One difference between support segment 28 and support segment 128 is that support segment 128 is thicker than support segment 28, which provides more rigidity in the assembled support structures 110, 112, 114, 118.

Each of the first and second end portions 148, 150 has a first mechanical connector 154 and a second mechanical connector 156. With respect to the anatomical coordinate system of the fingers, first mechanical connector 154 is configured to associate support segment 128 with a more distal support segment 130; second mechanical connector 156 is configured to associate support segment 128 with a more proximal support segment 126.

First mechanical connector 154 comprises first and second openings 158, 160 defined opposite one another in respective outwardly extending first and second connecting portions 162, 164. Compared with holes 58, 60 of support segment 28, openings 158, 160 are keyed, having shapes that are not fully radially symmetric.

First and second connecting portions 162, 164 project distally from support segment 128 and arise as central portion 152 merges into first and second end portions 148, 150. As is shown in the figures, first and second connecting portions 162, 164 are slightly recessed so as to lie inwardly of a first edge 166 of support segment 28. First edge 166 of support segment 128 acts as the outermost edge of support segment 128 distally; its contours will be described in greater detail below.

Second mechanical connector 156 comprises first and second posts 167, 168 positioned opposite one another on opposite, inwardly oriented faces of first and second end portions 148, 150. First and second posts 167, 168 are sized to fit within and cooperate with respective first and second holes 158, 160 of another support segment 128. Depending on the embodiment, first and second posts 167, 168 may be fully cylindrical in shape with flat, planar ends, or they may have rounded, semispherical ends. First and second posts 167, 168 with rounded ends may have certain advantages. For one, rounded post ends are less likely to snag any of the layers of fabric of glove 100. Rounded post ends may also simplify assembly and assist with alignment and interconnection tasks. For purposes of illustration, FIGS. 14 and 16 show first post 167 with a flat, planar end FIGS. 14 and 15 show and second post 168 with a rounded, semispherical end, although in most embodiments, first and second posts 167, 168 would have the same shape. Adjacent first and second posts 167, 168 is a second edge 170, which acts as the outermost edge of support segment 128 proximally.

Compared with first and second posts 66, 68 of support segment 28, first and second posts 167, 168 of support segment 128 are longer than first and second posts 66, 68 and include a set of keyed projections 172 that arise from their lateral surfaces and correspond to the shape of first and second openings 158, 160. The corresponding shapes of openings 158, 160 and first 168 and second posts with keyed projections 172 allow first 168 and second posts and openings 158, 160 to remain in engagement, and prevent the respective components from accidental disengagement.

Figure 17:
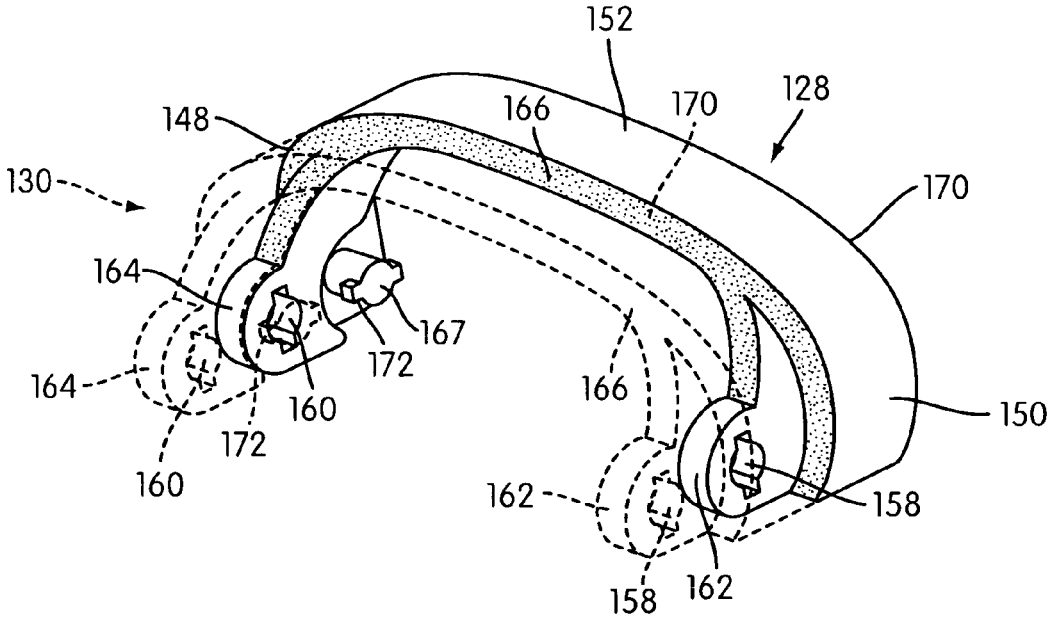
FIG. 17 is a perspective view of an intermediate support segment of the glove of FIG. 13 with another intermediate support segment shown in phantom, illustrating the extent of contact area between the two segments.

FIG. 17 is a perspective view of support segment 128 with a second interconnected support segment shown in phantom, illustrating the extent of contact area between the two at first edge 166. As shown, the contact between the two segments is in several planes, and is increased relative to the contact areas provided by the support structures 12, 14, 16, 18 of glove 10 due to the increased thickness of support segment 128. As will also be appreciated from FIG. 17 and FIG. 18, a perspective view of support segment 128 and a more distal support segment 130 in engagement, support segment 128 preferably includes at least some of the complex curvatures and features described above with respect to segments 28, 29. Depending on the embodiment, the intended use of glove 100, and other factors, the relatively increased thickness of support segment 128 relative to support segment 28 of glove 10, and corresponding increase in rigidity, may obviate the need for some of the segment engaging features found in support system 12 of glove 10.

Figure 18:
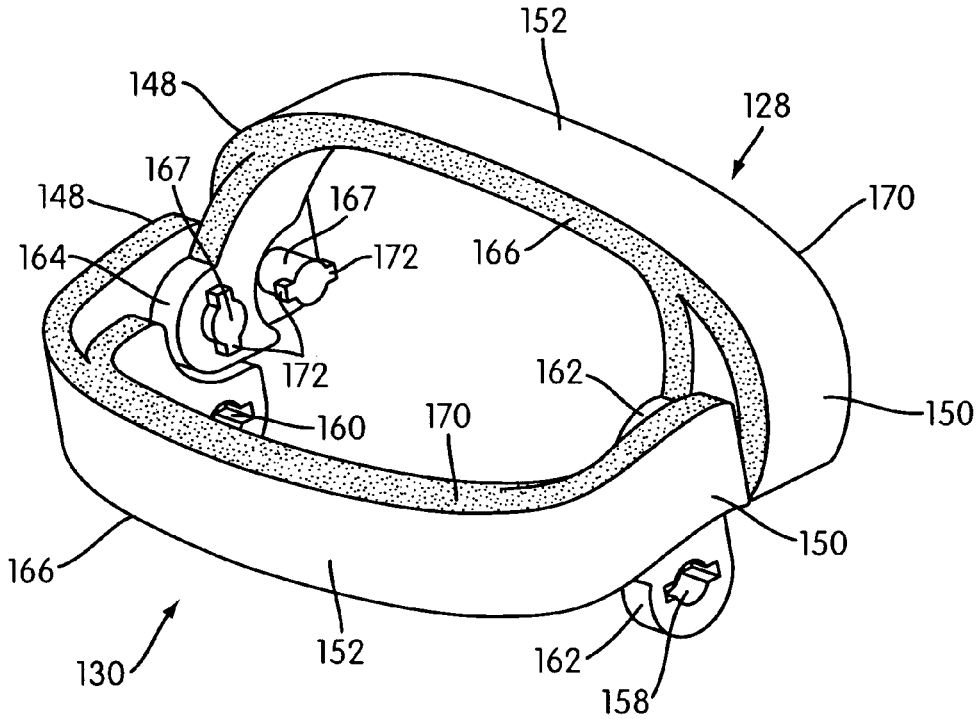
FIG. 18 is a perspective view of two connected intermediate support segments of the glove of FIG. 13, illustrating the pivoting of one with respect to the other.

FIG. 18 shows the engaged relationship of the first and second posts 167, 168 and the first and second openings 158, 160. As shown, the position and extent of keyed projections 172 on first and second posts 167, 168 allow free rotation between adjacent support segments 128, 130, but restrict medial-lateral movement of the support segments 128, 130.

FIGS. 19-23 illustrate the functions and positions of a support structure, generically illustrated as support structure 110, inside glove 100. Specifically, FIG. 19 is a schematic side elevational sectional view of a portion of glove 100 with finger 149 inside. FIG. 19 depicts the position of support structure 110 with finger 149 in the fully extended position. The tip of finger 149 is behind proximally extending anterior edge 180 of endcap support segment 146.

As will be appreciated from FIG. 19, support structure 110 prevents hyperextension of finger 149 because, in the illustrated position, the various segments 120, 122, 124, 126, 128, 130, 132, 134, 136, 138, 140, 142, 144 abut and will thus help to resist any additional extension or posterior movement. In other words, support structure 110 can help to add stiffness in the backward direction (rotating finger 149 clockwise in FIG. 19), thus helping to prevent finger 149 from being bent backwards, while at the same time, remaining flexible and loose in the forward direction. This arrangement provides a glove that provides support and stiffness beyond the natural range of motion of finger 149, while remaining flexible and loose within the range of motion of finger 149.

Preferably, support structure 110 is associated with glove 100 in a way that maximizes the flexibility, ease of motion and comfort while support system 110 is within the natural range of motion of finger 149. In some embodiments, this includes provisions that allow support structure 110 to slide with respect to glove 100 or various components of glove 100.

Figure 20:
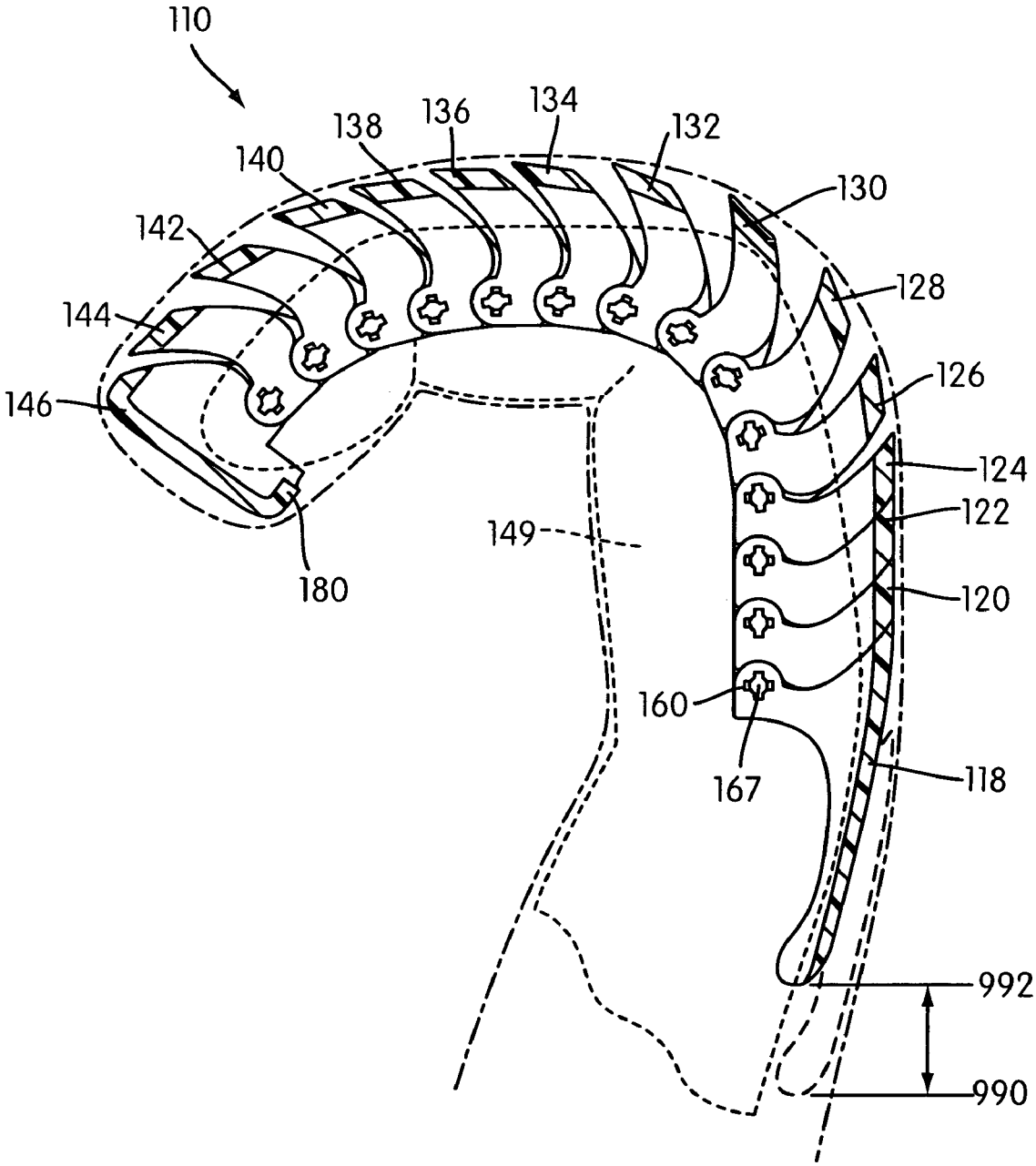
FIG. 20 is a side elevational sectional view similar to the view of FIG. 19, illustrating the support structure in a flexed position.

FIG. 20 is a schematic side elevational sectional view similar to the view of FIG. 19, but with finger 149, glove 100, and support structure 110 in flexion. In any position, be it extended, as shown in FIG. 19 or flexed, as shown in FIG. 20, support structure 110 constantly protects the anterior aspect of finger 149. In the view of FIG. 19, the tip of finger 149 remains behind anterior edge 180 of endcap support segment 146, which causes support segment 110 to move with the tip of finger 149.

In the description above, it was noted that support structure 110 is not secured in place, but rather, is free to slide along the pocket defined by second and third layers 104, 106. This preferred assembly is shown in FIG. 14. In other words, support structure 110 can move and "float" or slide along the pocket defined by second and third layers 104, 106.

Operation of this sliding motion can be seen by comparing FIGS. 19 and 20. When finger 149 is in the fully extended position illustrated in FIG. 19, support structure 110 is in a first position, which is indicated in phantom at 990 in FIG. 20. As finger 149 flexes with the tip of finger 149 behind anterior edge 180 of endcap support segment 146, support structure 110 slides distally, so that the tip of finger 149 remains snuggly behind endcap support segment 146 and the proximal edge of knuckle support segment 118 moves to a second position indicated at 992 in FIG. 20. This allows for a better fit of glove 100 and for more adaptable support from support structure 110.

It can be observed that support structure 110 moves from a first position 990 to a second position 992 when finger 149 is flexed. It can also be observed that portions of support structure 110 move relative to finger 149 and the wearer's hand. As shown in FIGS. 19 and 20, knuckle support segment 118 and lower support segments 120 and 122 are disposed in a first position with respect to the wearer's hand when finger 149 is extended, but then move to a second position with respect to the wearer's hand when finger 149 flexes.

In some embodiments, the support system includes provisions that allow the wearer to selectively engage, actuate or move one or more of the support structures. Preferably, a support system includes one support structure associated with each finger, and the wearer can selectively engage, actuate or move each support structure independently.

Figure 21:
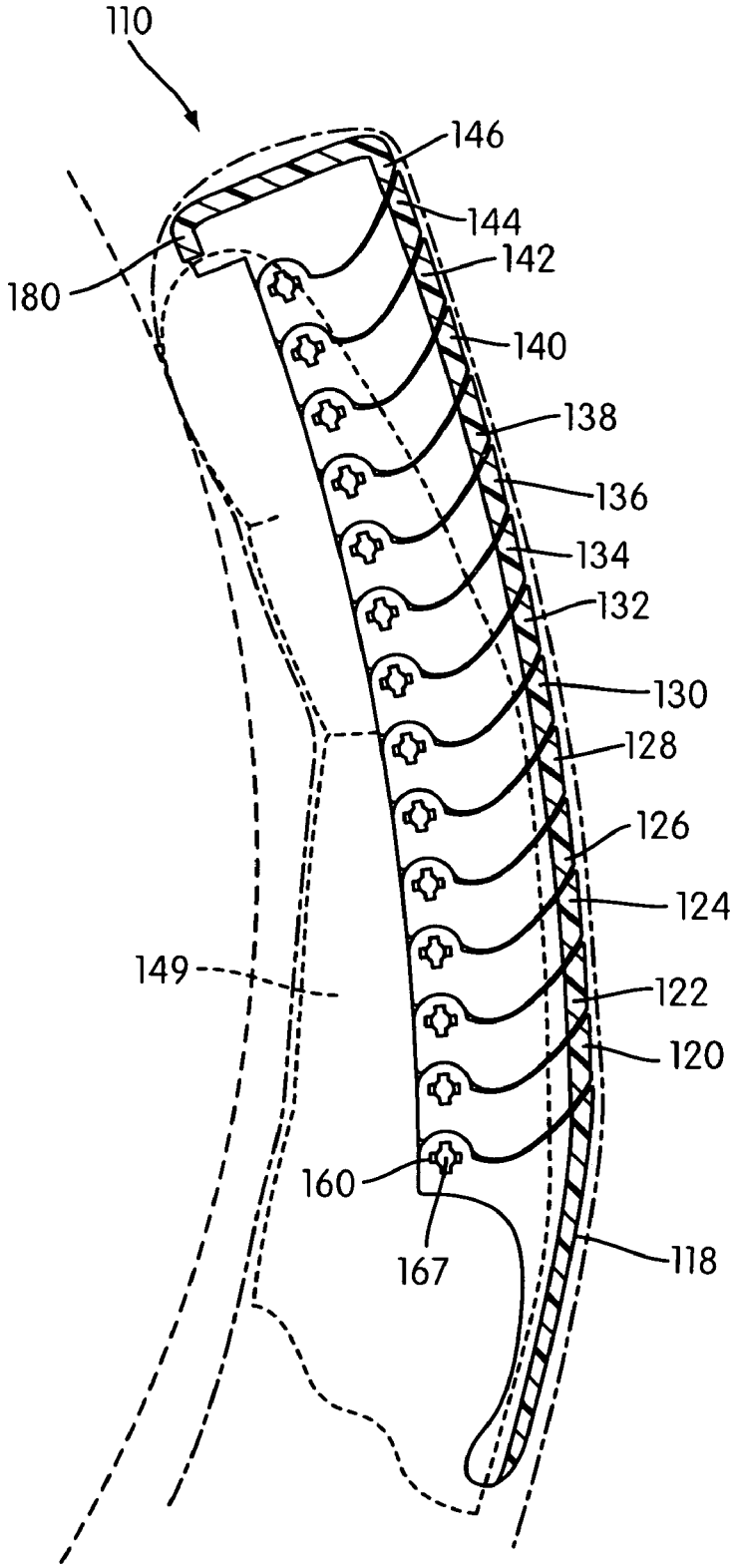
FIG. 21 is a side elevational sectional view similar to the view of FIG. 19, illustrating the support structure in a partially flexed position with a finger flexed and extending anteriorly of the support structure.

FIG. 21 is a schematic side elevational sectional view similar to the views of FIGS. 19 and 20. FIG. 21 illustrates one embodiment of this selective engagement, actuation or movement feature. In the embodiment shown in FIG. 21, endcap support segment 146 includes an inner portion 180. This inner portion 180 can be selectively engaged by finger 149. Either by slipping finger 149 past inner portion 180 or by pulling finger 149 back proximally, the wearer is able to select whether finger 149 engages inner portion 180.

In one preferred embodiment, shown in FIGS. 21 and 11, inner portion 80 or 180 extends a sufficient distance proximally from top portion 74 to allow selective engagement. The proximal length of inner portion 80 or 180 allows the wearer to conveniently and intuitively engage the inner portion 80 or 180 with either the finger tip or the finger nail. Inner portion 80 or 180 can also include an optional scallop or cut out portion to further refine the proximal length at particular points circumferentially along inner portion 80 or 180.

In those situations where the user elects to grab inner portion 180, support structure 110 moves as described above in connection with FIG. 20. However, in those situations where the user elects to slip finger 149 past inner portion 180, the following occurs. As finger 149 flexes in the position shown in FIG. 21, it pushes first layer 102. Eventually, since first layer 102 is connected to second and third layers 104, 106, support structure 110 will be pulled into partial flexion by forces exerted on it through the various layers, first, second, and third layers 102, 104, 106 of glove 100, as opposed to being moved directly by finger 149. Therefore, as shown in FIG. 21, finger 149 is more flexed than support structure 110, and there is only an indirect correspondence between the degree of flexion of finger 149 and the degree of flexion of support structure 110.

Avoiding support structure 110 may be helpful in some applications in which the wearer is attempting to catch or grip an object. In essence, the position of FIG. 21 allows finger 149 to move relatively freely while support structure 110 remains behind to act as a backstopping support within glove 100.

Figure 23:
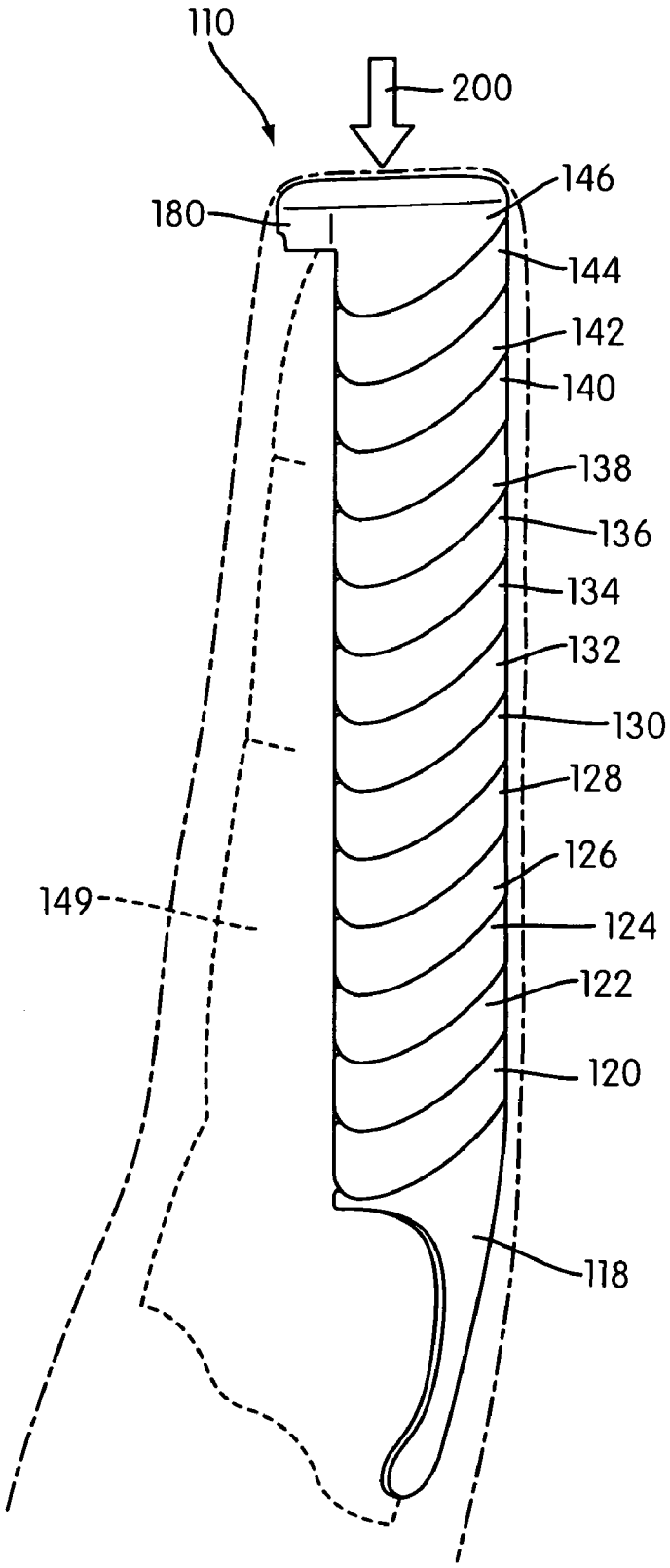
FIG. 23 is a side elevational view of a support structure, illustrating its resistance to compressive axial forces.

FIGS. 22 and 23 are, respectively, a schematic perspective and side elevational view of support structure 110, illustrating the result with applied torsional and axial forces. As shown in FIG. 22, support structure 110 resists twisting upon the application of torsional forces because of the complex curvature and close engagement of support segments 118, 120, 122, 124, 126, 128, 130, 132, 134, 136, 138, 140, 142, 144, 146.

FIG. 23 illustrates the application of a compressive axial force, indicated by arrow 200 to support structure 110. The overall shape of support structure 110 tends to reduce the likelihood of failure by column buckling. Additionally, since support segments 118, 120, 122, 124, 126, 128, 130, 132, 134, 136, 138, 140, 142, 144, 146 overlap each other and are closely positioned such that there is little slack, support structure 110 compresses relatively little under axial compressive loads. Therefore, support structure 110 protects finger 149 against, for example, sudden axial compressive loads that might cause a finger jamb or a crush injury along the finger.

Figure 24:
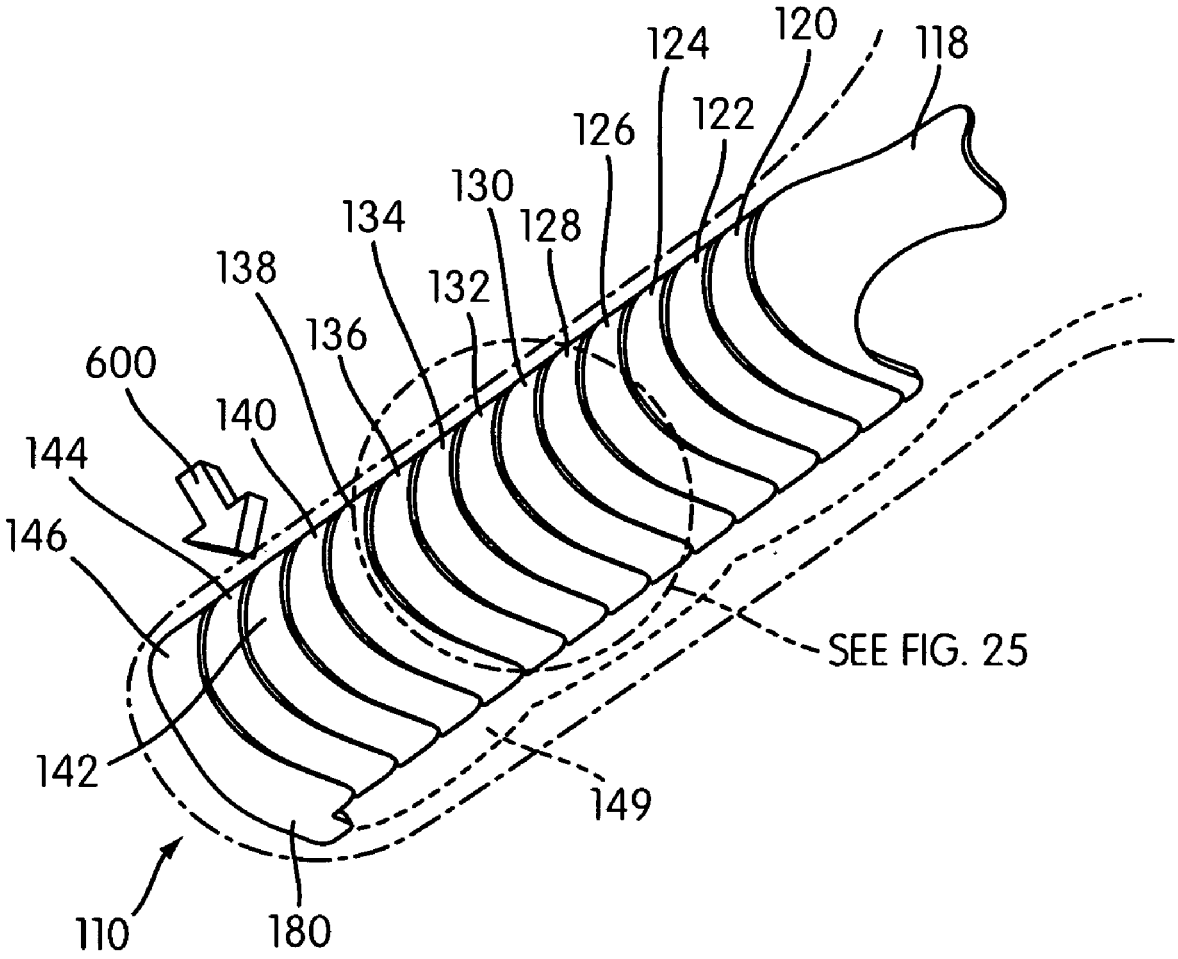
FIG. 24 is a perspective view of a support structure, illustrating its resistance to side impact forces.
Figure 25:
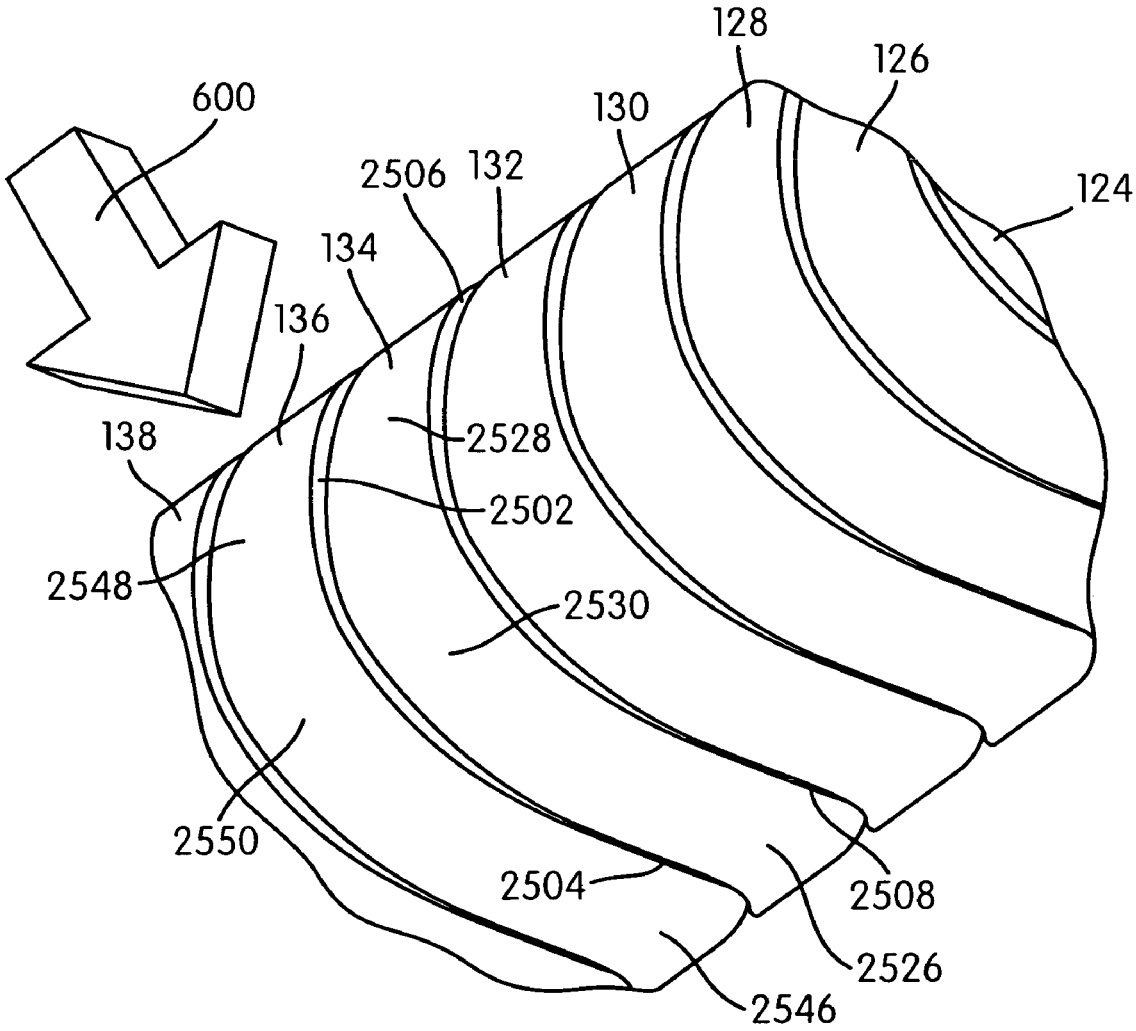
FIG. 25 is a magnified perspective view of a portion of the support structure of FIG. 24, illustrating its resistance to side impact forces in more detail.

FIG. 24 is a perspective view of a support structure 110 illustrating the application of a side impact force, indicated by arrow 600 at a point along the side face of support structure 110. FIG. 25 is a magnified perspective view of a portion of FIG. 24, illustrating the response of support structure 110.

As shown in FIGS. 24 and 25, side impact force 600 impacts support structure 110 around one of the middle support segments. In the example shown in FIGS. 24 and 25, middle support segment 136 is referred to as a "first middle support segment" and middle support segment 134 is referred to as a "second middle support segment." The terms, "first" and "second" are used to simply refer to the middle support segments and do not indicate or relate to their position with respect to other middle support segments, and endcap segment or a knuckle segment.

First middle support segment 136 includes first end portion 2546 and second end portion 2548. As disclosed above, these end portions 2546 and 2546 extend circumferentially from central portion 2550 of first middle segment 136. In the example shown in FIGS. 24 and 25, impact force 600 contacts support structure 110 around first middle support segment 136, and particularly, around the second end portion 2548 of first middle support segment 136.

The shape of support structure 110 helps to reduce the effect of impact force 600 on a wearer's hand. Second end portion 2548 is disposed around one side of the wearer's finger, and helps to absorb and distribute impact force 600. Without the curved shape of middle support segment 136, and the position of second end portion 2548 around the side of the wearer's finger, there would be little besides one of the glove layers (102 or 104) or gusset 107 (see FIG. 14) to stop impact force 600. The curved shape of support structure 110 around a wearer's finger and proximate the side of the wearer's finger helps to reduce the effects of side impact forces like side impact force 600.

In the Example shown in FIGS. 24 and 25, side impact force 600 strikes first middle support segment 136, usually through a glove layer, for example, glove layer 104 or gusset 107 (see FIG. 14). Side impact force 600 is absorbed and distributed by second end portion 2548 of first middle support segment 136. Second end portion 2548 helps to prevent side impact force 600 from directly striking the wearer's finger.

In some cases, and with some types of impacts, support structure 110 can also distribute the load of side impact force 600 in the following way. Side impact force 600 causes the distance between at least two support segments, in this case, middle support segments 134 and 136 to increase on one side, as indicated by first gap 2502, and to decrease on the opposite side of support structure 110, as indicated by second gap 2504. Specifically, as shown in FIG. 25, first gap 2502 is disposed between second end portion 2548 of first middle support segment 136 and second end portion 2528 of second middle support segment 134. And second gap 2504 is disposed between first end portion 2546 of first middle support segment 136 and first end portion 2526 of second middle support segment 134. The gap between adjacent support segments on the side of the impact can increase, while the gap between adjacent support segments on the opposite side of the impact can decrease.

Because of the nature of the engagement of middle support segments 134 and 136, both in terms of shape and they way they are connected to one another, the amount of movement caused by impact force 600 is limited. At second gap 2504, middle support segments 134 and 136 are in full abutment, which prevents any further gap opening at first gap 2502.

Depending on the nature of the impact force and its location, the phenomenon illustrated by first gap 2502 and second gap 2504 may occur between other adjacent support segments as well, and in some cases, can occur along the length of support structure 110. In the example shown in FIGS. 24 and 25, other segments have also pivoted or shifted along the axial length of support structure 110. In the example shown in FIG. 25, this change in gaps also occurs between second middle support segment 134 and third middle support segment 132. Comparing the size of third gap 2506, which is on the side of the support structure 110 receiving the side impact, with the size of fourth gap 2508, which is on the side opposite the side receiving the side impact, the difference in gap size between second middle support segment 134 and third middle support segment 132 can be observed. This change in gap size can be observed in other pairs of adjacent support segments as well. The complex curvature, shape, and close engagement of segments tend to distribute the force along the entire support segment 110 and dissipate the force to some degree without subjecting the wearer to excessive lateral bending forces or bending displacement.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A glove comprising:

a first layer configured to contact a palm of a hand; and a support system for a finger comprising:

at least one support structure including a first segment and an adjacent second segment;

the first segment including a first side portion that extends along a first side of the finger, a second side portion that extends along a second side of the finger, and a first central portion that extends across a top of a finger between the first side portion and the second side portion;

the first side portion including a first mechanical connector including a first hole and a second mechanical connector including a first post;

the second segment including a second central portion that extends across the top of the finger, a third side portion that extends along the first side of the finger, and a fourth side portion that extends along the second side of the finger;

the second side portion including a third mechanical connector including a second hole and a fourth mechanical connector including a second post;

wherein the first hole is configured to receive the second post to connect the first segment with the second segment;

wherein the second post pivots within the first hole allowing the first segment to pivot with respect to the second segment; and wherein the first post is integrally formed on the second mechanical connector and the second post is integrally formed on the fourth mechanical connector.

2. The glove according to claim 1, wherein the first segment is substantially similar to the second segment.

3. The glove according to claim 1, wherein the first central portion includes a first edge disposed proximal to the first mechanical connector.

4. The glove according to claim 1, wherein the first post and the second post extend away from the support structure toward the finger.

5. The glove according to claim 1, wherein the first support segment includes a circumferentially curved portion.

6. The glove according to claim 1, wherein a portion of the second support segment includes a circumferential curved portion that corresponds to the portion of the first segment that is circumferentially curved.

7. The glove according to claim 6, wherein the first support segment is disposed distally with respect to the second support segment, and wherein the circumferentially curved portion of the second support segment extends axially towards the first support segment and axially distal to at least one mechanical connector of the first support segment.

8. The glove according to claim 1, wherein at least one of the first mechanical connector and the second mechanical connector is circumferentially spaced from the circumferentially curved portion of the first support segment.

9. The glove according to claim 1, further comprising a second layer, wherein the support system is disposed between the wearer's hand and the second layer.

10. The glove according to claim 9, further comprising a third layer, wherein the support system is disposed between the second layer and the third layer.

11. The glove according to claim 10, wherein the support structure slides axially with respect to the second and third layer.

12. A glove comprising:

a first layer configured to contact a palm portion of a wearer's hand;

a second layer configured to contact a back portion of a wearer's hand; and a support system associated with the second layer, the support system comprising:

a support structure including a plurality of support segments; the support structure having a first support segment configured to pivot with respect to an adjacent second support segment;

the first segment including a first side portion that extends along a first side of a finger, a second side portion that extends along a second side of the finger, and a first central portion that extends across a top of the finger between the first side portion and the second side portion;

the first side portion including a first mechanical connector including a first hold and a second mechanical connector including a first post;

the second segment including a second central portion that extends across the top of the finger, a third side portion that extends along the first side of the finger, and a fourth side portion that extends along the second side of the finger;

the second side portion including a third mechanical connector including a second hole and a fourth mechanical connector including a second post;

wherein the first hole is configured to receive the second post to connect the first segment with the second segment;

wherein the second post pivots within the first hole allowing the first segment to pivot with respect to the second segment;

wherein the first post is integrally formed on the second mechanical connector and the second post is integrally formed on the fourth mechanical connector; and wherein the first support segment includes a circumferentially curved portion.

13. The glove according to claim 12 further comprising a third layer associated with the second layer to form a pocket between the second layer and the third layer, wherein the support system is disposed within the pocket.

14. The glove according to claim 13, wherein the support system is configured to move freely within the pocket.

15. A glove comprising:

a first layer configured to contact a palm portion of a wearer's hand;

a second layer configured to contact a back portion of a wearer's hand; and a support system associated with the second layer, the support system comprising:

a support structure including a plurality of support segments; the support structure having a first support segment configured to pivot with respect to an adjacent second support segment;

the first segment including a first side portion that extends along a first side of a finger, a second side portion that extends along a second side of the finger, and a first central portion that extends across a top of the finger between the first side portion and the second side portion;

the first side portion including a first mechanical connector including a first hole and a second mechanical connector including a first post;

the second segment including a second central portion that extends across the top of the finger, a third side portion that extends along the first side of the finger, and a fourth side portion that extends along the second side of the finger;

the second side portion including a third mechanical connector including a second hole and a fourth mechanical connector including a second post;

wherein the first hole is configured to receive the second post to connect the first segment with the second segment;

wherein the second post pivots within the first hole allowing the first segment to pivot with respect to the second segment;

wherein the first post is integrally formed on the second mechanical connector and the second post is integrally formed on the fourth mechanical connector;

the first support segment including a proximal edge;

the proximal edge of the first support segment being angled at a first angle;

the second support segment including a distal edge configured to contact the proximal edge of the first support segment;

the distal edge of the second support segment being angled at a second angle, wherein the first angle and the second angle are supplementary.

16. The glove according to claim 15, wherein an upper edge of the distal edge of the second support segment is disposed distal to a lower edge of the proximal edge of the first support segment.

17. The glove according to claim 15, wherein the first and second segments present a substantially smooth inner surface when connected.

18. The glove according to claim 15, wherein the first and second segments present a substantially smooth outer surface when connected.

* * * * *